US009676182B2

(12) United States Patent
Kiyokawa

(10) Patent No.: US 9,676,182 B2
(45) Date of Patent: Jun. 13, 2017

(54) PRINTING APPARATUS AND CALIBRATION METHOD THEREOF

(71) Applicant: CANON KABUSHIKI KAISHA, Tokyo (JP)

(72) Inventor: Yusuke Kiyokawa, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/151,983

(22) Filed: May 11, 2016

(65) Prior Publication Data

US 2016/0347053 A1 Dec. 1, 2016

(30) Foreign Application Priority Data

May 29, 2015 (JP) ..... 2015-110798

(51) Int. Cl.
*B41J 2/045* (2006.01)
*B41J 29/393* (2006.01)

(52) U.S. Cl.
CPC ..... *B41J 2/04556* (2013.01); *B41J 2/04501* (2013.01); *B41J 2/04506* (2013.01); *B41J 2/04513* (2013.01); *B41J 2/04586* (2013.01); *B41J 2/04508* (2013.01); *B41J 29/393* (2013.01); *B41J 2029/3935* (2013.01)

(58) Field of Classification Search
CPC B41J 2/04556; B41J 2/04501; B41J 2/04513; B41J 2/04506; B41J 2029/3935; B41J 2/04508; B41J 29/393
See application file for complete search history.

(56) References Cited

U.S. PATENT DOCUMENTS

2003/0169310 A1* 9/2003 Arquilevich ..... B41J 29/393 347/19
2005/0024414 A1* 2/2005 Chong Hin ..... B41J 29/393 347/19
2005/0100385 A1* 5/2005 Sato ..... B41J 11/0095 400/708
2015/0273823 A1* 10/2015 Kato ..... B41J 2/04573 347/9

FOREIGN PATENT DOCUMENTS

JP 2008-265058 A 11/2008

* cited by examiner

*Primary Examiner* — Henok Legesse
(74) *Attorney, Agent, or Firm* — Fitzpatrick, Cella, Harper & Scinto

(57) ABSTRACT

According to an embodiment the present invention, a printing apparatus detects a distance between a printhead and a print medium using a sensor while using a print medium for sensor calibration and changing a height from a print position to a carriage, stores first distance information indicating a relationship between the height and a signal representing a result of detecting the distance for each of heights in a memory, obtains second distance information indicating a relationship between the height and the signal representing the result of detecting the distance for each of the heights while using a predetermined print medium and changing the height, compares the first and second distance information, and corrects the first distance information stored in the memory, based on a result of the comparison.

18 Claims, 16 Drawing Sheets

RANGING SENSOR OUTPUT DISTRIBUTION

DISTANCE INFORMATION REFERENCE TABLE

PRINTING APPARATUS AND CALIBRATION METHOD THEREOF

BACKGROUND OF THE INVENTION

Field of the Invention

The present invention relates to a printing apparatus and a calibration method thereof, and particularly to, for example, a printing apparatus capable of detecting the distance from a printhead to a print medium using a sensor, and a calibration method of the sensor.

Description of the Related Art

Conventionally, an inkjet printing apparatus (to be referred to as a printing apparatus hereinafter) includes a number of sensors according to various purposes to, for example, raise the quality or resolution of a printed image or improve operability. For example, the printing apparatus includes a sensor that detects the width of a print medium such as print paper set on the printing apparatus, a sensor that detects the density of a print adjustment pattern printed on print paper, and a ranging sensor that detects the thickness of print paper.

By the way, minute ink particles, which do not land on a print medium and are called an ink mist, are dispersed from ink discharged from an inkjet printhead (to be referred to as a printhead hereinafter) used in the printing apparatus. The ink mist is dispersed together with an air flow created as the air in the apparatus is disturbed by, for example, the movement of a carriage with the printhead, adheres to various places, and contaminates the interior of the apparatus. The ink mist may adhere to the ranging sensor configured to detect the distance between print paper and the printhead, an encoder sensor and a linear scale configured to detect the position of the carriage, or an encoder sensor and a code wheel configured to detect the rotation amount of a print medium conveyance roller. When the ink mist adheres, detection errors may occur in the detection units, resulting in a failure in image printing or the operation of the apparatus.

Conventionally, an optical ranging sensor is used in the printing apparatus. Ranging detection using the sensor is generally performed in the following way. That is, the emitting element of the sensor irradiates a measurement target with light. A photoreception element receives the light reflected by the measurement target. The distance to the measurement target is obtained using triangulation.

In some conventional printing apparatuses, a ranging sensor is mounted on a carriage that includes a printhead and reciprocally moves. In the ranging sensor, a plurality of photoreception elements provided in the sensor irradiate a measurement target with light, receive the light reflected by the measurement target, and measure the ratio value of the intensity of the reflected light to that of the output light. The distance up to print paper is calculated based on a reference result of the measurement result and a distance information reference table that shows relationship between a light intensity and a distance detected by a calibration reference board mounted on the printing apparatus (see Japanese Patent Laid-Open No. 2008-265058).

In the prior art, however, if an ink mist adheres to the sensor over time, the degrees of adhesion to the plurality of emitting elements and photoreception elements are not always equal. In addition, if the degrees of adhesion to the plurality of photoreception elements are not equal, the ranging accuracy lowers. To solve this problem, a method of calibrating the ranging sensor as needed using a calibration reference board may be used. However, this arrangement greatly increases the cost of the apparatus.

SUMMARY OF THE INVENTION

Accordingly, the present invention is conceived as a response to the above-described disadvantages of the conventional art.

For example, a printing apparatus and a calibration method thereof according to this invention are capable of accurately and inexpensively measuring the distance between a printhead and a print medium.

According to one aspect of the present invention, there is provided a printing apparatus for, using a printhead mounted on a carriage that reciprocally moves in a predetermined direction, printing a print medium conveyed in a direction different from the predetermined direction, comprising: a detection unit provided on the carriage and configured to detect a distance between the printhead and the print medium at a print position by the printhead, a change unit configured to change a height from a print position to the carriage; a storage unit configured to store first distance information indicating a relationship between the height and a signal representing a result of detection of the distance by the detection unit for each of a plurality of heights while using a print medium for calibration of the detection unit and causing the change unit to change the height; an obtaining unit configured to obtain second distance information indicating a relationship between the height and the signal representing the result of detection of the distance by the detection unit for each of the plurality of heights while using a predetermined print medium and causing the change unit to change the height; and a correction unit configured to compare the first distance information and the second distance information and correct the first distance information stored in the storage unit, based on a result of the comparison.

According to another aspect of the present invention, there is provided a calibration method in a printing apparatus that, using a printhead mounted on a carriage that reciprocally moves in a predetermined direction, prints a print medium conveyed in a direction different from the predetermined direction and detects a distance between the printhead and the print medium at a print position by the printhead using a sensor provided on the carriage, the method comprising: detecting the distance between the printhead and the print medium while using a print medium for calibration of the sensor and changing a height from the print position to the carriage; storing, in a memory, first distance information indicating a relationship between the height and a signal representing a result of detecting the distance by the sensor for each of a plurality of heights; obtaining second distance information indicating a relationship between the height and the signal representing the result of detecting the distance by the sensor for each of the plurality of heights while using a predetermined print medium and changing the height; and comparing the first distance information and the second distance information and correcting the first distance information stored in the memory, based on a result of the comparison.

The invention is particularly advantageous since even if, for example, a foreign substance adheres to a unit that detects the distance between a print medium and the printhead, and lowers the sensitivity of the unit, it is possible to accurately measure the distance by recalibrating the unit and correcting the ranging detection result without using a member such as a calibration board. This makes it possible to inexpensively maintain the detection accuracy of a detection unit, for example, a sensor.

The invention also contributes to optimize the distance between the print medium and the printhead and more satisfactorily keep the position of the printhead at the time of printing.

Further features of the present invention will become apparent from the following description of exemplary embodiments (with reference to the attached drawings).

DESCRIPTION OF THE EMBODIMENTS

Exemplary embodiments of the present invention will now be described in detail in accordance with the accompanying drawings.

In this specification, the terms "print" and "printing" not only include the formation of significant information such as characters and graphics, but also broadly include the formation of images, figures, patterns, and the like on a print medium, or the processing of the medium, regardless of whether they are significant or insignificant and whether they are so visualized as to be visually perceivable by humans.

Also, the term "print medium" not only includes a paper sheet used in common printing apparatuses, but also broadly includes materials, such as cloth, a plastic film, a metal plate, glass, ceramics, wood, and leather, capable of accepting ink.

Furthermore, the term "ink" (to be also referred to as a "liquid" hereinafter) should be extensively interpreted similar to the definition of "print" described above. That is, "ink" includes a liquid which, when applied onto a print medium, can form images, figures, patterns, and the like, can process the print medium, and can process ink. The process of ink includes, for example, solidifying or insolubilizing a coloring agent contained in ink applied to the print medium.

Further, a "print element" generically means an ink orifice or a liquid channel communicating with it, and an element for generating energy used to discharge ink, unless otherwise specified.

<Outline of Printing Apparatus (FIG. 1)>

Figure 1:
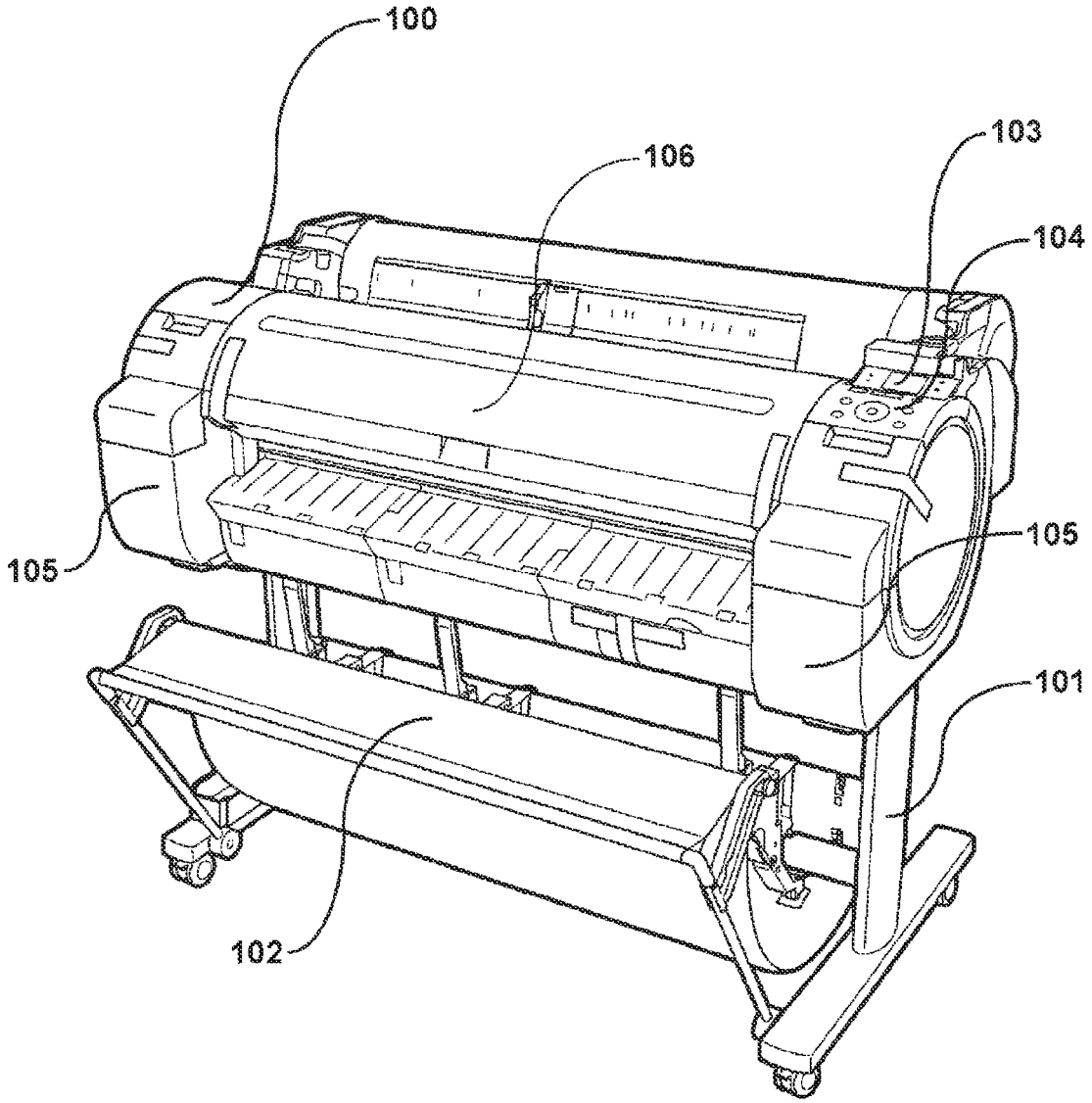
FIG. 1 is a perspective view showing the outer appearance of a printing apparatus that uses a print medium in the A0 or B0 size according to an exemplary embodiment of the present invention.

FIG. 1 is a perspective view showing the outer appearance of an inkjet printing apparatus that uses a large print medium such as A0 or B0 size according to an exemplary embodiment of the present invention.

An inkjet printing apparatus (to be referred to as a printing apparatus hereinafter) 100 shown in FIG. 1 can print roll paper in 10 to 44 inches. The printing apparatus 100 includes a stand 101 on which the main body is placed, and a stacker 102 on which discharged print paper is stacked. A display panel 103 used to display various kinds of print information and setting results and an operation panel 104 used to set a print mode or print paper size are disposed on the upper surface of the printing apparatus 100. The printing apparatus 100 also includes an upper cover 106 that can be opened/closed.

Ink tank accommodation units 105 used to accommodate ink tanks of black, cyan, magenta, yellow, and the like and supply inks to a printhead are arranged on both sides of the printing apparatus 100.

Figure 2:
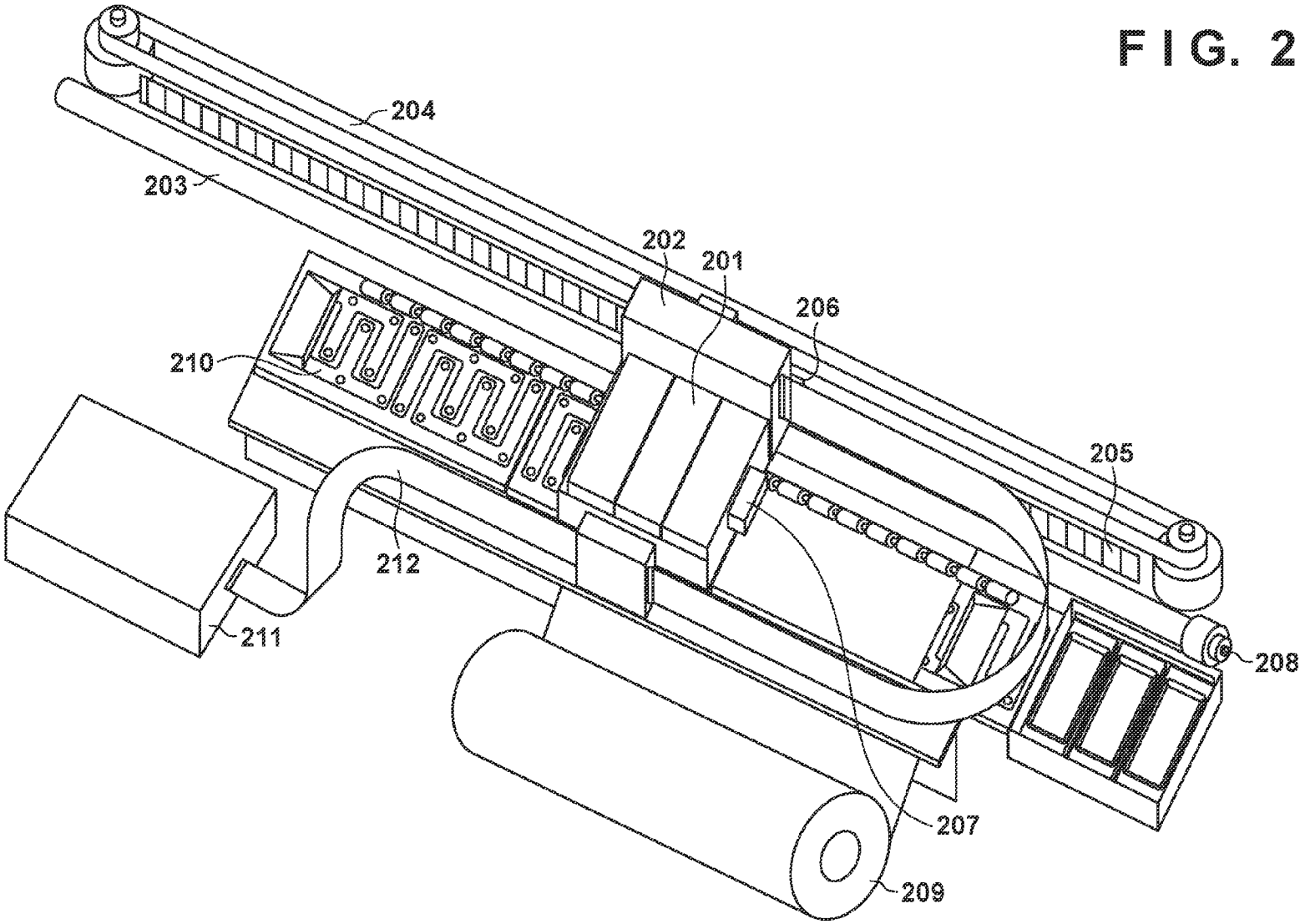
FIG. 2 is a partial perspective view showing the arrangement of the printing apparatus shown in FIG. 1 on the periphery of an ink tank.

FIG. 2 is a view schematically showing the interior of the printing apparatus shown in FIG. 1 near an ink tank accommodation unit.

As shown in FIG. 2, a printhead 201 supplies electric energy to electrothermal transducers in the printhead 201 based on print data sent from a host device (not shown), thereby generating thermal energy. The generated thermal energy forms bubbles in the supplied ink. Nozzles in the printhead 201 discharge ink droplets by a pressure generated at the time of bubble formation.

A carriage 202 with the printhead 201 is guided by a main rail 203 and a carriage belt 204 and reciprocally scanned in a direction perpendicular to the conveyance direction of print paper 209. At this time, the printhead 201 discharges ink droplets to print. The printhead 201 is provided with a plurality of nozzles. The nozzle arrays discharge inks of black, cyan, magenta, yellow, and the like to form an image on a print medium. At this time, the carriage 202 reads a scale provided on a linear scale 205, and an encoder sensor 206 outputs the result as a pulse signal. By counting the pulse signals, the relative moving distance and position of the carriage 202 are detected.

The carriage 202 also includes a ranging sensor 207 configured to detect the distance between the print paper 209 and the printhead 201. Since the carriage 202 reciprocally moves according to a print operation, the ranging sensor 207 can detect the distance between the print paper 209 and the printhead 201 at the print position of the printhead 201.

The carriage 202 is set to a plurality of heights by a lift elevating motor 208 in accordance with the type or thickness of print paper. The print paper 209 is supported by a platen 210 and conveyed by a conveyance roller (not shown). Power to drive the printhead 201 and the carriage 202 is supplied from a power supply unit 211 via a flat cable 212.

Note that ink is supplied from each ink tank (not shown) accommodated in the ink tank accommodation unit 105 to the printhead 201 via an ink tube (not shown).

Figure 3:
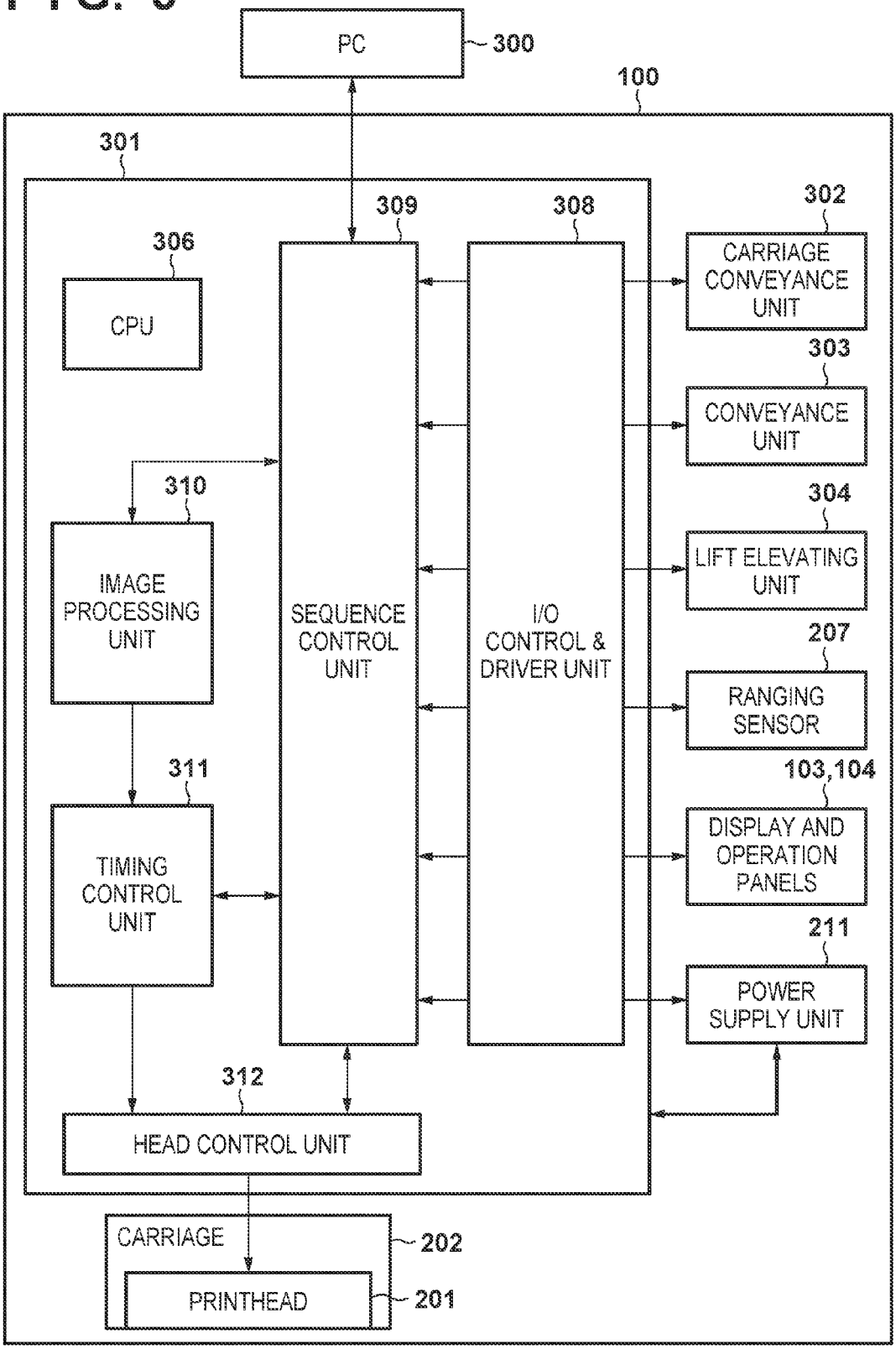
FIG. 3 is a block diagram showing the control configuration of the printing apparatus shown in FIG. 1.

FIG. 3 is a block diagram showing the control configuration of the printing apparatus 100. As shown in FIG. 3, a personal computer (PC) 300 is connected to control the print operation of the printing apparatus 100.

The printing apparatus 100 includes a control unit 301 configured to control the entire apparatus, driving units 302 to 304, the carriage 202 including the printhead 201, the ranging sensor 207, the power supply unit 211, the display panel 103, and the operation panel 104. The carriage conveyance unit 302 is formed from a carriage motor used to drive the carriage 202 via the carriage belt 204, and the like. The conveyance unit 303 is formed from a conveyance roller that conveys the print paper 209, a discharge roller, a conveyance motor configured to drive these rollers, and the like. Note that the control unit 301 includes a CPU 306, and the remaining portions are made of ASICs.

The lift elevating unit 304 is connected to the lift elevating motor 208, coupled with a lift cam (not shown) and the main rail 203, and configured to adjust the height of the carriage 202. The lift elevating unit 304 can change the height in multiple stages based on the stop position of the lift cam, and can also grasp the height change amount at a predetermined accuracy.

The ranging sensor 207 is used to detect the distance between the printhead 201 and the print paper 209 and also reflect it on print control based on various kinds of reference information stored in a memory (to be described later) provided in the printing apparatus 100. The power supply unit 211 is used to supply power to the control unit 301 and cause the driving units 302 to 304 to operate.

As described with reference to FIG. 1, the display panel 103 and the operation panel 104 are used by the user to operate the main body of the printing apparatus 100.

The control unit 301 includes an I/O control & driver unit 308, a sequence control unit 309, an image processing unit 310, a timing control unit 311, and a head control unit 312. The sequence control unit 309 executes general print control, that is, activation and stop of functional blocks, print paper conveyance control, carriage scan control, and the like. The I/O control & driver unit 308 generates a control signal based on an instruction from the sequence control unit 309 to control each driving unit, and also transmits an input signal from each driving unit to the sequence control unit 309. The image processing unit 310 performs image processing of, for example, decomposing input image data from the PC 300 into color components such as black, cyan, magenta, and yellow and converting the data into print data. The timing control unit 311 transfers the print data converted/generated by the image processing unit 310 to the head control unit 312 in association with the position of the carriage 202. The head control unit 312 converts the print data input from the timing control unit 311 into a head control signal and outputs it. In addition, the head control unit 312 controls the temperature of the printhead 201 based on an instruction from the sequence control unit 309.

Figure 4:
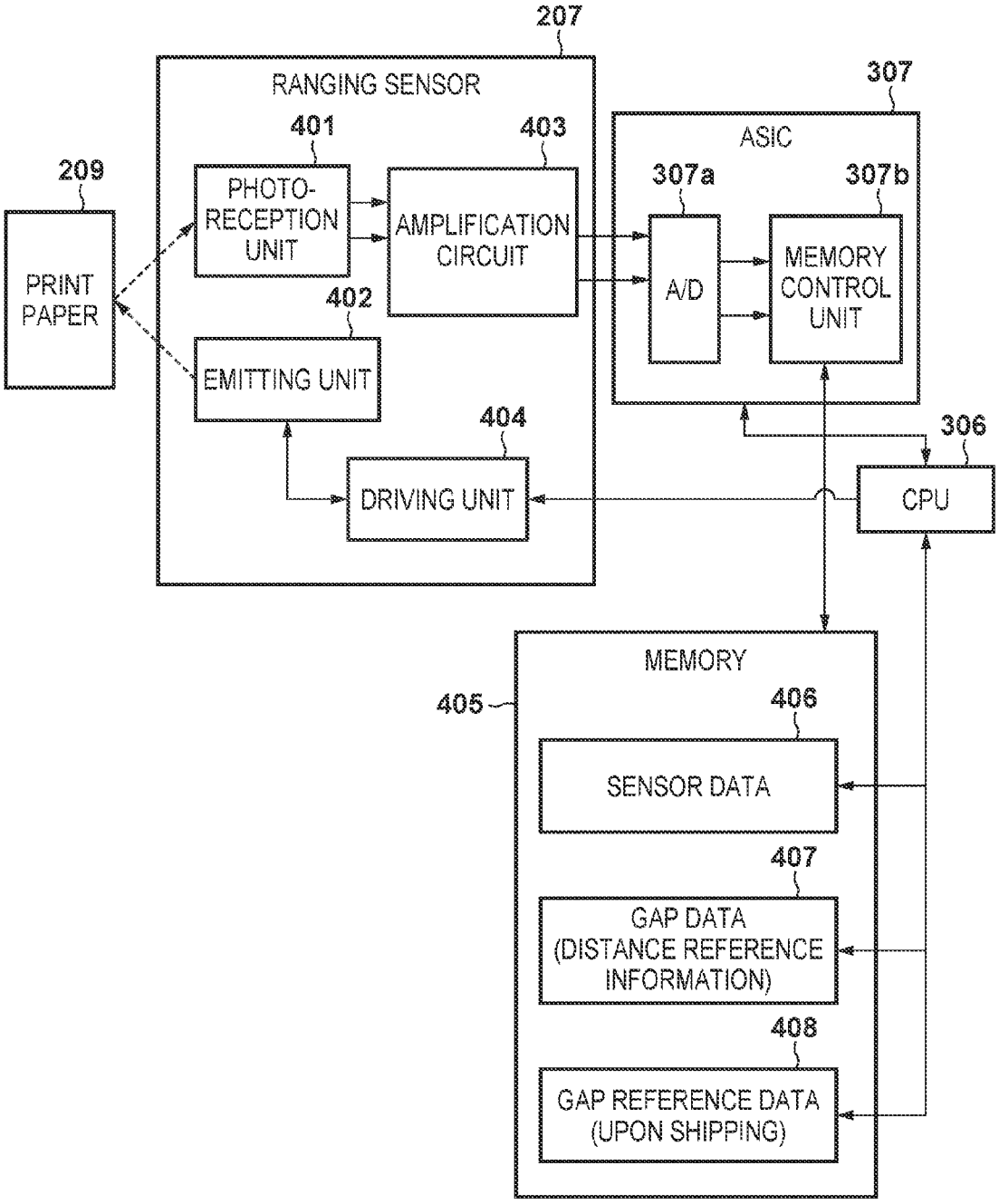
FIG. 4 is a block diagram showing an arrangement for detecting the distance between a printhead and print paper.

FIG. 4 is a block diagram showing an arrangement for detecting the distance between print paper and the printhead. FIG. 4 shows the arrangement concerning processing of an input/output signal of the ranging sensor 207 and accompanying driving processing of each block.

The ranging sensor 207 includes an emitting unit 402 serving as a light source, a plurality of photoreception units 401, and a driving unit 404 that on/off-control the emitting unit 402 on the print paper 209. When the emitting unit 402 irradiates the print paper 209 with light, the light is reflected by the print paper 209, and the plurality of photoreception units 401 receive the reflected light. The plurality of photoreception units 401 each photoelectrically convert the received light and output an electrical signal according to the intensity of the reflected light. The ranging sensor 207 also includes an amplification circuit 403 that receives the electrical signal output from each photoreception unit 401 and amplifies the current value or voltage value. In this embodiment, an LED is used as the light source of the emitting unit 402.

The amplified electrical signal from each of the plurality of photoreception units 401 is input to an A/D conversion circuit 307*a* in an ASIC 307. The A/D conversion circuit 307*a* converts the amplified electrical signal into a digital value. The digital value (sensor data) is stored in a storage area 406 of a memory 405 via a memory control unit 307*b* in the ASIC 307.

The memory 405 also stores data used to perform predetermined correction processing from a calculation result of the CPU 306. For example, GAP data (distance reference information) indicating the relationship between the ratio value of the electrical signals output from the plurality of photoreception units 401 and the distance from the printhead 201 to the print paper 209 is stored in a storage area 407. Additionally, for example, GAP reference data (for example, peak output data of each photoreception unit) serving as the reference to a calibration result of the ranging sensor 207 upon shipping of the apparatus is stored in a storage area 408. As described above, the memory 405 is used to temporarily store the values.

Figure 5A:
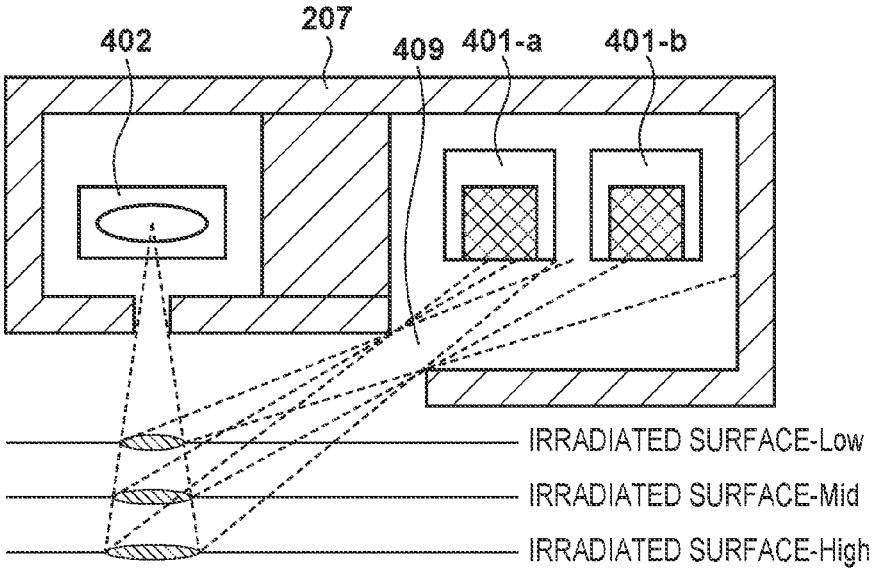
FIGS. 5A and 5B are views showing the internal arrangement of a ranging sensor and a change in the positions of an irradiation region and a photoreception region which change in accordance with the distance to the irradiated surface of print paper.
Figure 5B:
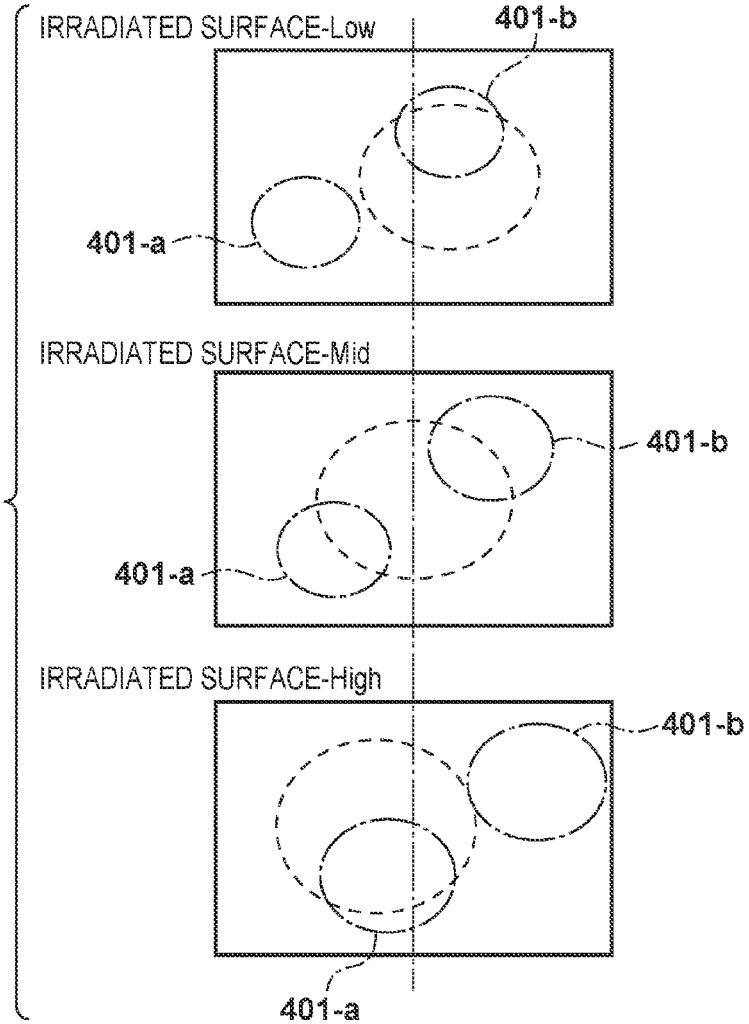

FIGS. 5A and 5B are views showing the internal arrangement of the ranging sensor and a change in the positions of an irradiation region and a photoreception region which change in accordance with the distance to the irradiated surface of print paper.

As shown in FIG. 5A, the ranging sensor 207 includes one emitting unit 402 and two photoreception units 401-*a* and 401-*b*. If the distance from the ranging sensor 207 to the print paper 209 changes, the incident angles of the reflected light to the photoreception units 401-*a* and 401-*b* change in an opening 409 through which reflected light from the irradiated surface (reflection surface) of the print paper 209 enters. FIG. 5A shows three different distances. The shorter the distance is, the lower the height of the carriage (the height of the printhead) is (irradiated surface-Low). The longer the distance is, the higher the height of the carriage is (irradiated surface-High).

FIG. 5B shows how the spot of light (irradiated region) emitted by the emitting unit 402 to the irradiated surface (reflection surface) looks on the photoreception surfaces of the two photoreception units in accordance with the distance from the ranging sensor 207 to the print paper 209. Referring to FIG. 5B, each broken line indicates how the spot of light emitted by the emitting unit 402 looks on the photoreception surfaces. The alternate long and short dashed lines indicate the photoreception ranges (photoreception regions) of the two photoreception units 401-*a* and 401-*b*.

As shown in FIG. 5B, when the distance from the ranging sensor 207 to the print paper 209 changes, the light amounts that enter the photoreception surfaces of the two photoreception units change. Hence, the intensities of obtained electrical signals are also different.

Figure 6A:
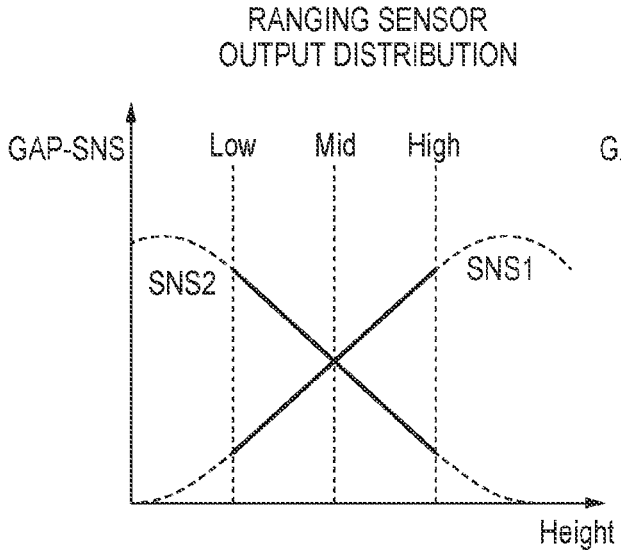
FIGS. 6A and 6B are views showing a change in the output of the ranging sensor according to the distance to the irradiated surface of print paper and the characteristic of a distance information reference table.
Figure 6B:
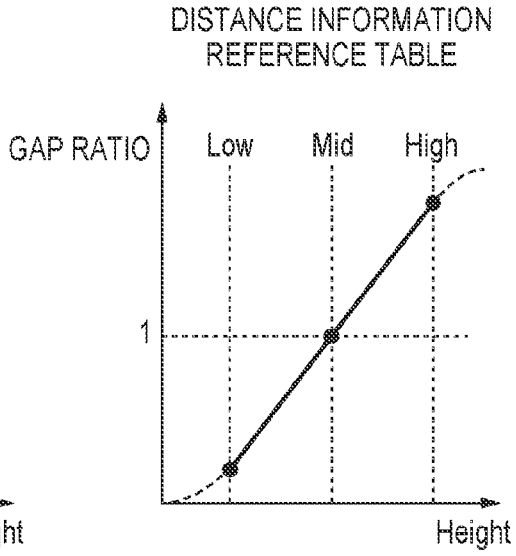

FIGS. 6A and 6B are views showing a change in the output of the ranging sensor according to the distance to the irradiated surface of print paper and the characteristic of a distance information reference table. In FIGS. 6A and 6B, the abscissa represents the distance from the platen 210 to the printhead 201 as a carriage height (Height).

FIG. 6A shows light amount distributions obtained when the irradiation light from the emitting unit 402 is reflected by the irradiated surface (reflection surface) and received by the two photoreception units 401-*a* and 401-*b*. SNS1 indicates a change in the received light amount (GAP-SNS) on the photoreception unit 401-*a*, and SNS2 indicates a change in the received light amount (GAP-SNS) on the photoreception unit 401-*b*.

With the ordinate representing the ratio (GAP ratio) of the outputs of the two photoreception units, FIG. 6B shows the relationship between the GAP ratio and the carriage height (Height). In particular, FIG. 6B shows a distance information reference table indicating the relationship between the ratio and the distance from the printhead 201 or the ranging sensor 207 to the print paper 209 generated based on a result of distance reference information.

As shown in FIG. 6A, when the distance from the irradiated surface of the print paper 209 is Low, the received light amount on the photoreception unit 401-*b* is maximized, and the received light amount on the photoreception unit 401-*a* is minimized. For this reason, as for the light amount distributions on the two photoreception units 401-*a* and 401-*b* of the ranging sensor 207, SNS2 exhibits the maximum value, and SNS1 exhibits the minimum value. Additionally, as shown in FIG. 6B, the ratio of the received light amounts on the two photoreception units of the ranging sensor 207, that is, the value on the distance information reference table exhibits the minimum value.

When the distance to the irradiated surface of the print paper 209 is Mid, the received light amounts on the photoreception units 401-*a* and 401-*b* are about ½ those in the peak. For this reason, as for the light amount distributions on the ranging sensor 207, the outputs of SNS2 and SNS1 equal, as shown in FIG. 6A. Hence, as shown in FIG. 6B, the ratio of the received light amounts on the two photoreception units of the ranging sensor 207, that is, the value on the distance information reference table becomes 1.

Finally, when the distance to the irradiated surface of the print paper 209 is High, the received light amount on the photoreception unit 401-*b* is minimized, and the received light amount on the photoreception unit 401-*a* is maximized. For this reason, as for the light amount distributions on the ranging sensor 207, SNS2 exhibits the minimum value, and SNS1 exhibits the maximum value, as shown in FIG. 6A. Hence, as shown in FIG. 6B, the ratio of the received light amounts on the ranging sensor 207, that is, the value on the distance information reference table exhibits the maximum value.

Several embodiments of correcting the distance information reference table in a case where an ink mist adheres to the ranging sensor 207 to lower the sensitivity in the printing apparatus having the above-described arrangement will be described next. Note that the recalibration of the ranging sensor 207 may be executed, for example, in a case in which the number of ink droplets discharged from the printhead has exceeded a predetermined amount, or upon detecting that the output of the ranging sensor 207 has decreased by a predetermined amount when print paper has passed immediately under the ranging sensor 207.

First Embodiment

An example will be described here with reference to FIGS. 7A to 9, in which distance information reference table data is corrected in a case where the ranging accuracy of a ranging sensor 207 lowers, for example, after completion of discharge of a predetermined amount of ink droplets.

Figure 7A:
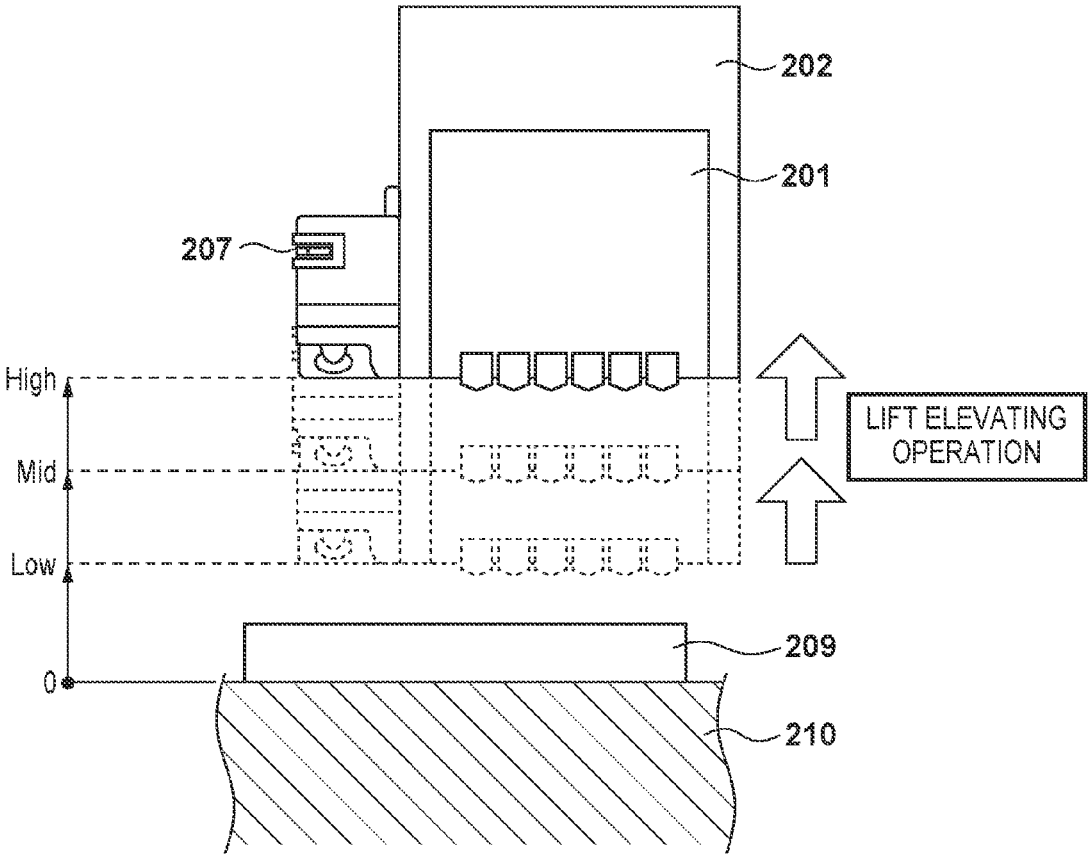
FIGS. 7A, 7B, and 7C are views showing the outputs of photoreception units in a case where the sensitivity of a ranging sensor is not lowered by ink mist adhesion and a distance information reference table.
Figure 7B:
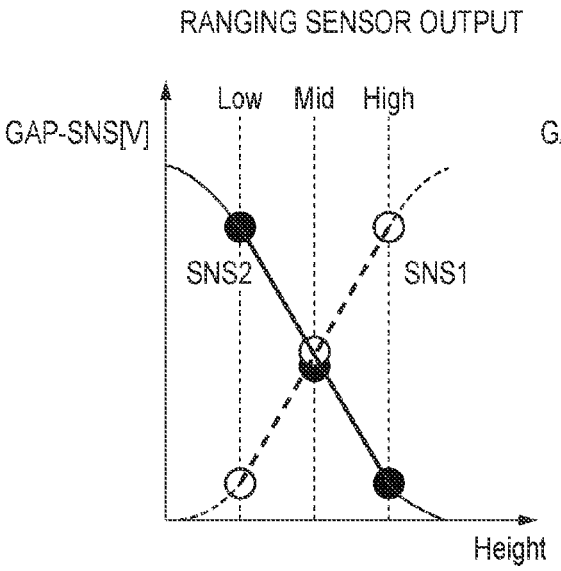
Figure 7C:
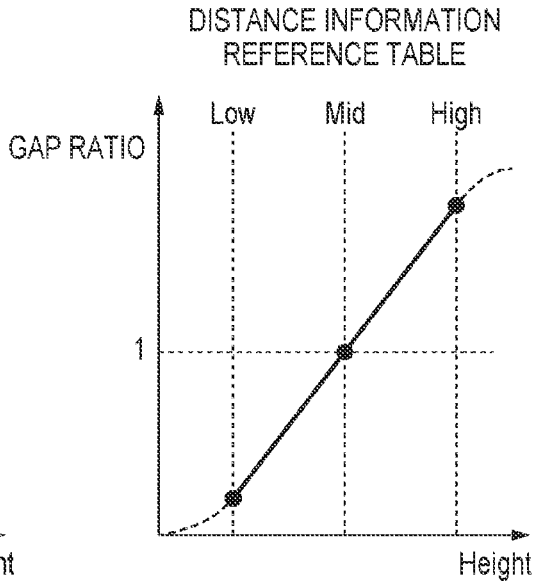

FIGS. 7A to 7C are views showing the outputs of photoreception units in a case where the sensitivity of a ranging sensor 207 is not lowered by ink mist adhesion and a distance information reference table.

Figure 9:
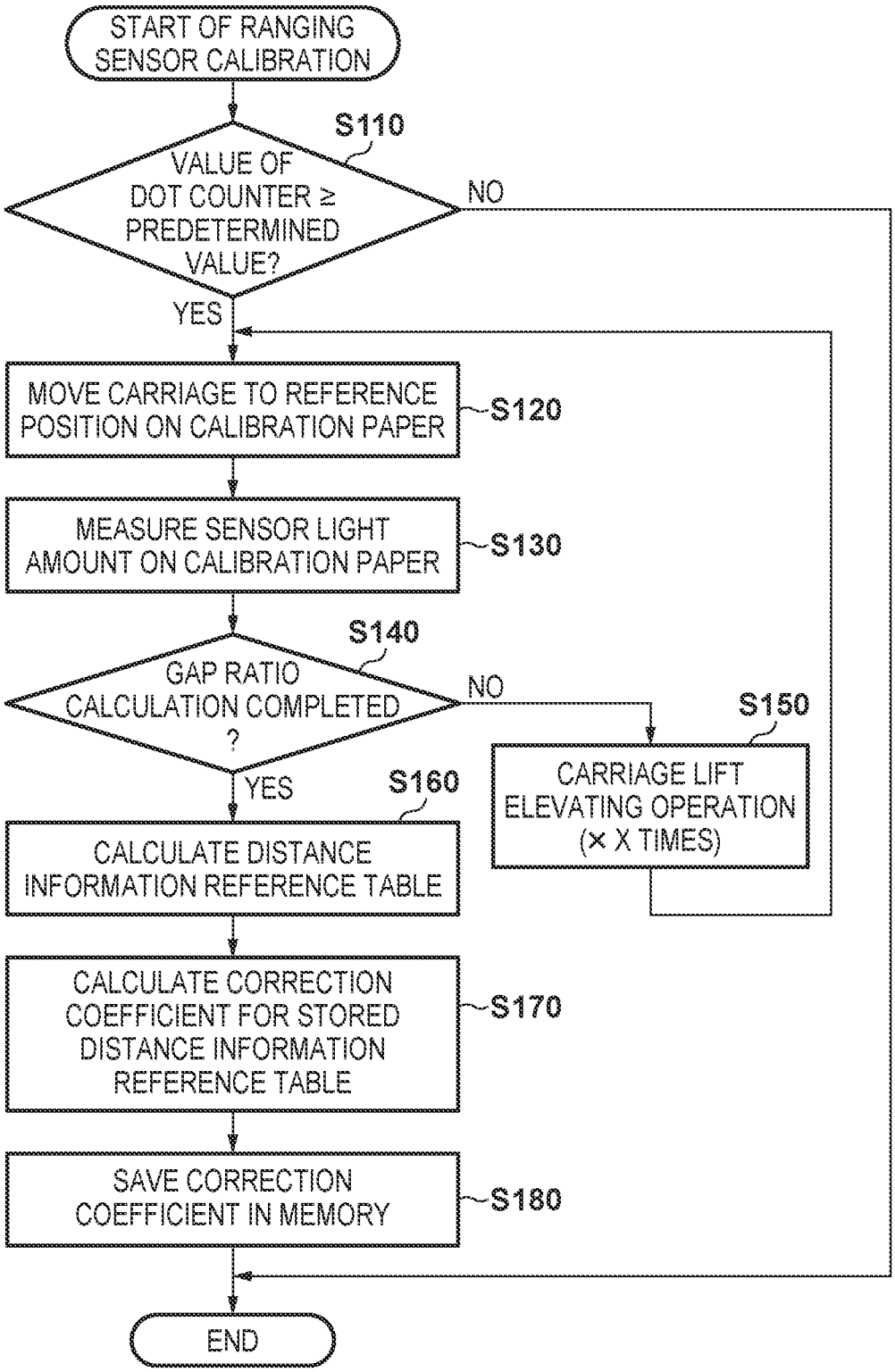
FIG. 9 is a flowchart showing recalibration of the ranging sensor and correction processing of the distance information reference table.

How to create the distance information reference table will be described here with reference to the flowchart of FIG. 9. Note that FIG. 9 shows processing used to recalibrate the ranging sensor. Hence, only processing steps necessary to first create a distance information reference table will be described here, and processing steps for correcting the table will be described later.

Step S110 is skipped. In step S120, print paper 209 for calibration, whose thickness or distance from a printhead 201 is known, is fed, and a carriage 202 is moved to a reference position for ranging. In this embodiment, measurement is performed at three different carriage heights (the height from a platen 210 to the ink discharge surface of the printhead 201), as shown in FIG. 7A. Here, the three carriage heights are Low (low), Mid (middle), and High (high). Setting the first reference position to the carriage height Low, a lift elevating unit 304 drives a lift elevating motor 208 to move the carriage 202.

Next, in step S130, when the print paper 209 is conveyed to a point immediately under the ranging sensor 207, the LED is turned on, an emitting unit 402 irradiates the print paper 209 with light, and two photoreception units 401-*a* and 401-*b* measure the reflected light amounts.

After that, in step S140, output signals (GAP-SNS) of the two photoreception units 401-*a* (SNS1) and 401-*b* (SNS2) are detected, and the ratio (GAP ratio) of the output signals from the two photoreception units is calculated. It is checked whether calculation of the GAP ratio is completed. In this embodiment, measurement is performed at three different carriage heights, as suggested in FIG. 7A. Hence, the process advances to step S150 to change the carriage height, and the processes of steps S120 to S140 are repeated.

When the GAP ratios are calculated at the three different carriage heights (Low, Mid, and High), the process advances to step S160.

FIG. 7B shows the output signal curves of the photoreception units obtained from the measured values at the three points by plotting the output signals (GAP-SNS) of the two photoreception units 401-*a* (SNS1) and 401-*b* (SNS2) at the three different carriage heights.

In step S160, the relationship between the GAP ratio and the carriage height (Height) is calculated from the GAP ratios at the three different carriage heights. FIG. 7C is a view showing the relationship between the GAP ratio and the carriage height (Height). This relationship is stored in a storage area 408 of a memory 405 as distance reference information in the initial state using a table format (distance information reference table: GAP reference data upon shipping).

Note that steps S170 and S180 are processes for correcting the table, and a description thereof will be omitted here.

The number of times of light amount measurement performed on the two photoreception units while changing the carriage height is not limited to three and may be larger, as a matter of course.

Recalibration of the ranging sensor and correction of the distance information reference table which are executed in a case where the printing apparatus is used, and the sensitivity of the ranging sensor is expected to lower due to ink mist adhesion will be described here with reference to the flowchart of FIG. 9.

Figure 8A:
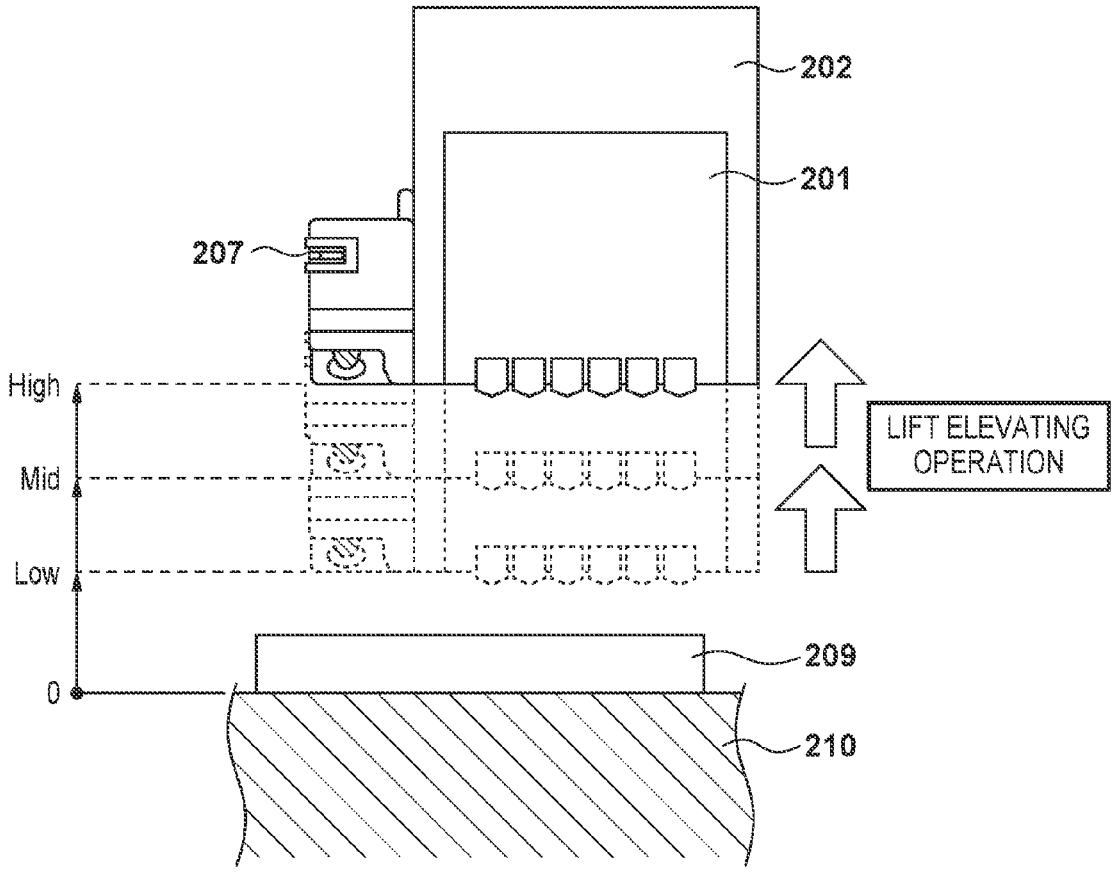
FIGS. 8A, 8B, and 8C are views showing the outputs of the photoreception units in a case where the sensitivity of the ranging sensor is lowered by ink mist adhesion and a distance information reference table newly obtained by recalibrating the ranging sensor.
Figure 8B:
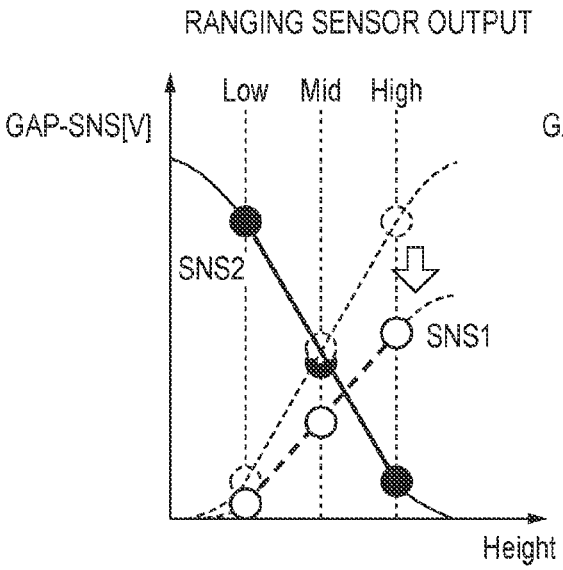
Figure 8C:
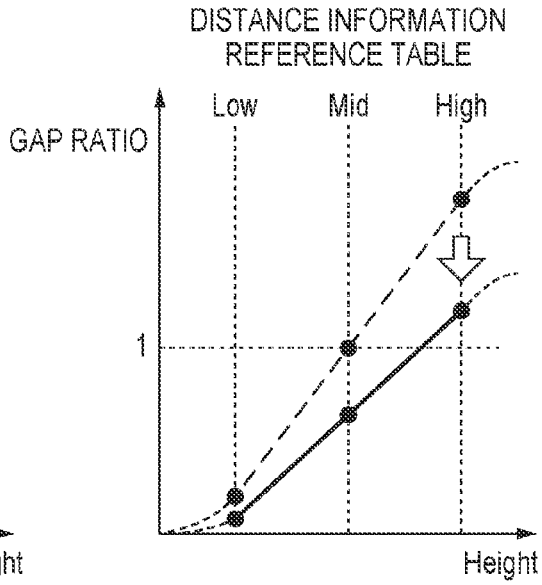

FIGS. 8A to 8C are views showing the outputs of the photoreception units in a case where the sensitivity of the ranging sensor 207 is lowered by ink mist adhesion and a distance information reference table newly obtained by recalibrating the ranging sensor. Note that the reference numerals and symbols shown in FIGS. 8A to 8C are the same as those in FIGS. 7A to 7C, and a description thereof will be omitted.

First, in step S110, it is checked whether the count value (DCNT) of a dot counter that counts the number of ink droplets discharged from the printhead 201 is equal to or larger than a predetermined threshold (TH). If DCNT≥TH, the process advances to step S120. If DCNT<TH, the processing directly ends.

In step S120, the print paper 209 for calibration is fed, as described above, and the above-described processes of steps S120 to S150 are executed. Note that the print paper for calibration can be the same as that used initially. However, the print paper need not be the same, and any print paper may be used as long as it exhibits the same optical characteristic and has the same thickness as the print paper for calibration used initially.

Even in a case in which the outputs from the two photoreception units of the ranging sensor 207 lower due to the influence of ink mist adhesion, if the degrees of output lowering equal, the calculated GAP ratio does not change. In this case, since the distance reference information indicating the distance from the printhead 201 to the print paper 209 does not change, the ranging sensor 207 need not be recalibrated. However, if one of the two photoreception units suffers a decrease in the sensitivity due to ink mist adhesion, the GAP ratio changes. Hence, the distance reference information changes from that stored initially.

FIG. 8B shows a state in which the output signal from the photoreception unit 401-*b* (SNS2) does not change, but the intensity of the output signal from the photoreception unit 401-*a* (SNS1) lowers. Referring to FIG. 8B, the dotted line indicates the initial value of the photoreception unit 401-*a* (SNS1), and the thick broken line indicates a value after the sensitivity has lowered. FIG. 8C shows an initial GAP ratio (broken line) and a GAP ratio (solid line) after the sensitivity of the photoreception unit 401-*a* (SNS1) has lowered.

Such a decrease in the output signal of the photoreception unit causes an error in ranging detection from the printhead 201 to the print paper 209.

In the process of step S160, the relationship between the GAP ratio and the carriage height (Height) in a case in which the sensitivity of the photoreception unit 401-*a* (SNS1) has lowered is calculated as a distance information reference table. In step S170, the difference between the initial distance information reference table and the newly calculated distance information reference table is calculated as a correction coefficient. In step S180, the correction coefficient is stored in a storage area 407 of the memory 405.

Note that the initial distance information reference table stored in a storage area 406 of the memory 405 may be replaced with the distance information reference table calculated in step S160.

Hence, according to the above-described embodiment, if the number of ink droplets discharged from the printhead is equal to or larger than a predetermined number, recalibration of the ranging sensor can be performed. This recalibration is normally done by a serviceman. However, the user may execute the recalibration by himself/herself if, for example, he/she owns print paper for calibration.

Second Embodiment

An example will be described here with reference to FIGS. 10A to 11, in which the distance information reference table of a ranging sensor 207 is corrected using print paper 801 which is used by a user and whose thickness or distance from a printhead 201 is known.

Figure 10A:
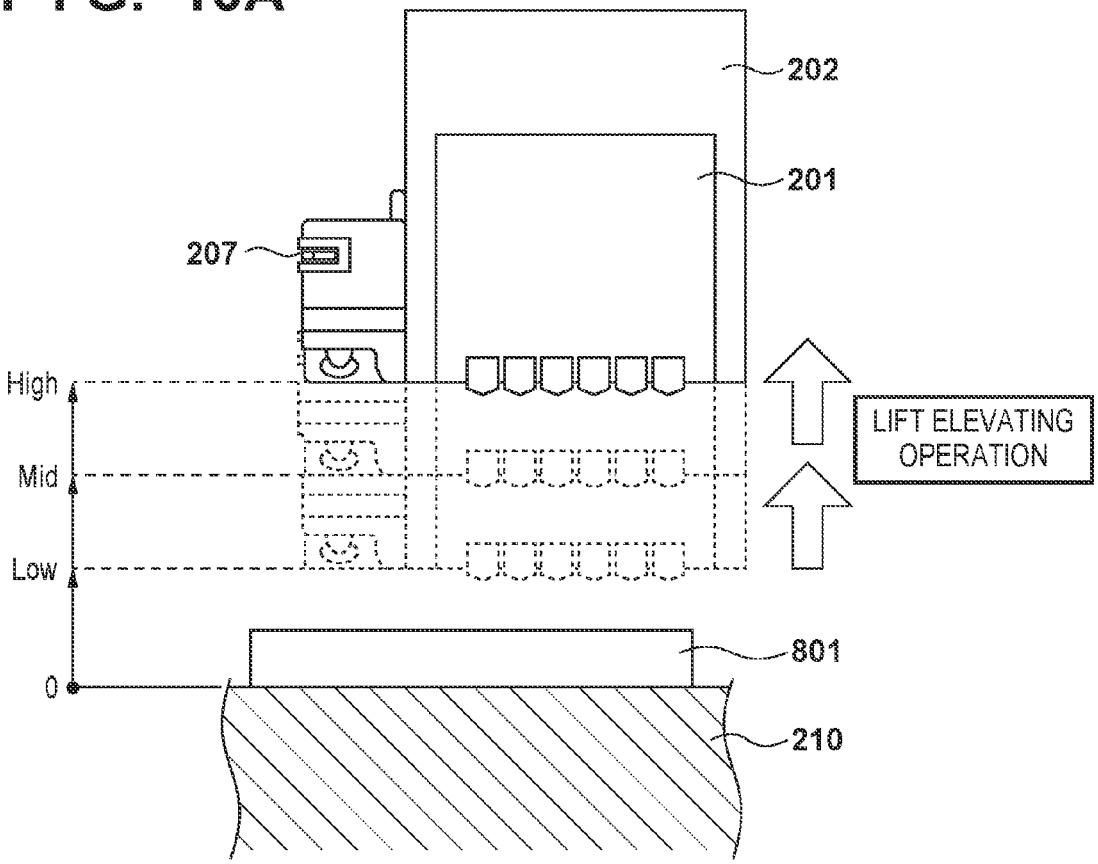
FIGS. 10A, 10B, and 10C are views showing the outputs of photoreception units upon recalibrating a ranging sensor using print paper and a distance information reference table newly obtained by recalibrating the ranging sensor.
Figure 10B:
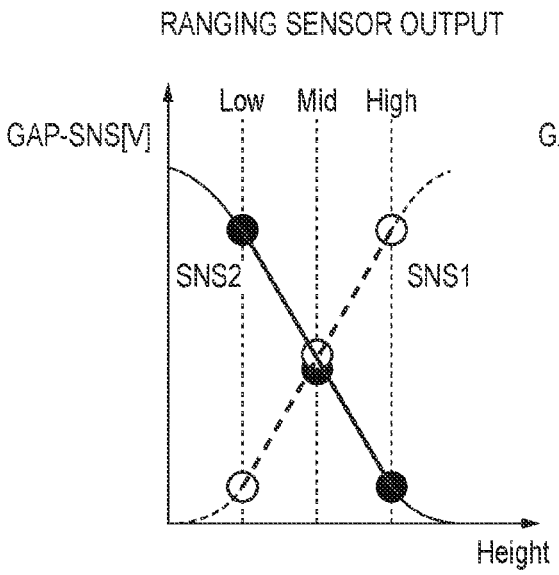
Figure 10C:
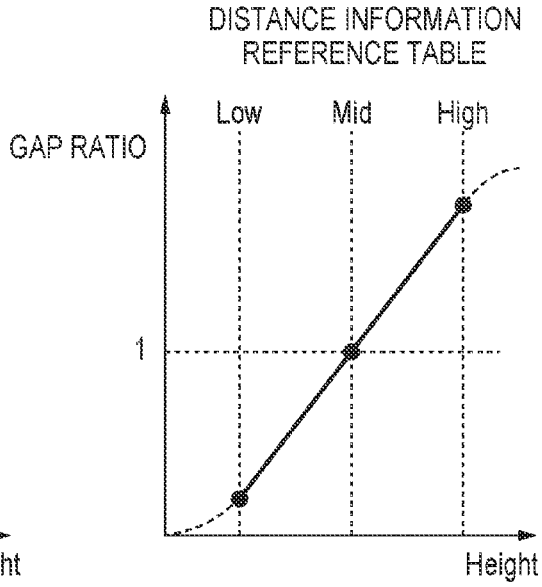

FIGS. 10A to 10C are views showing the outputs of photoreception units upon recalibrating the ranging sensor 207 using the print paper 801 and a distance information reference table newly obtained by recalibrating the ranging sensor. Note that the same reference numerals and symbols as in FIGS. 7A to 7C and 8A to 8C denote the same parts in FIGS. 10A to 10C, and a description thereof will be omitted.

Figure 11:
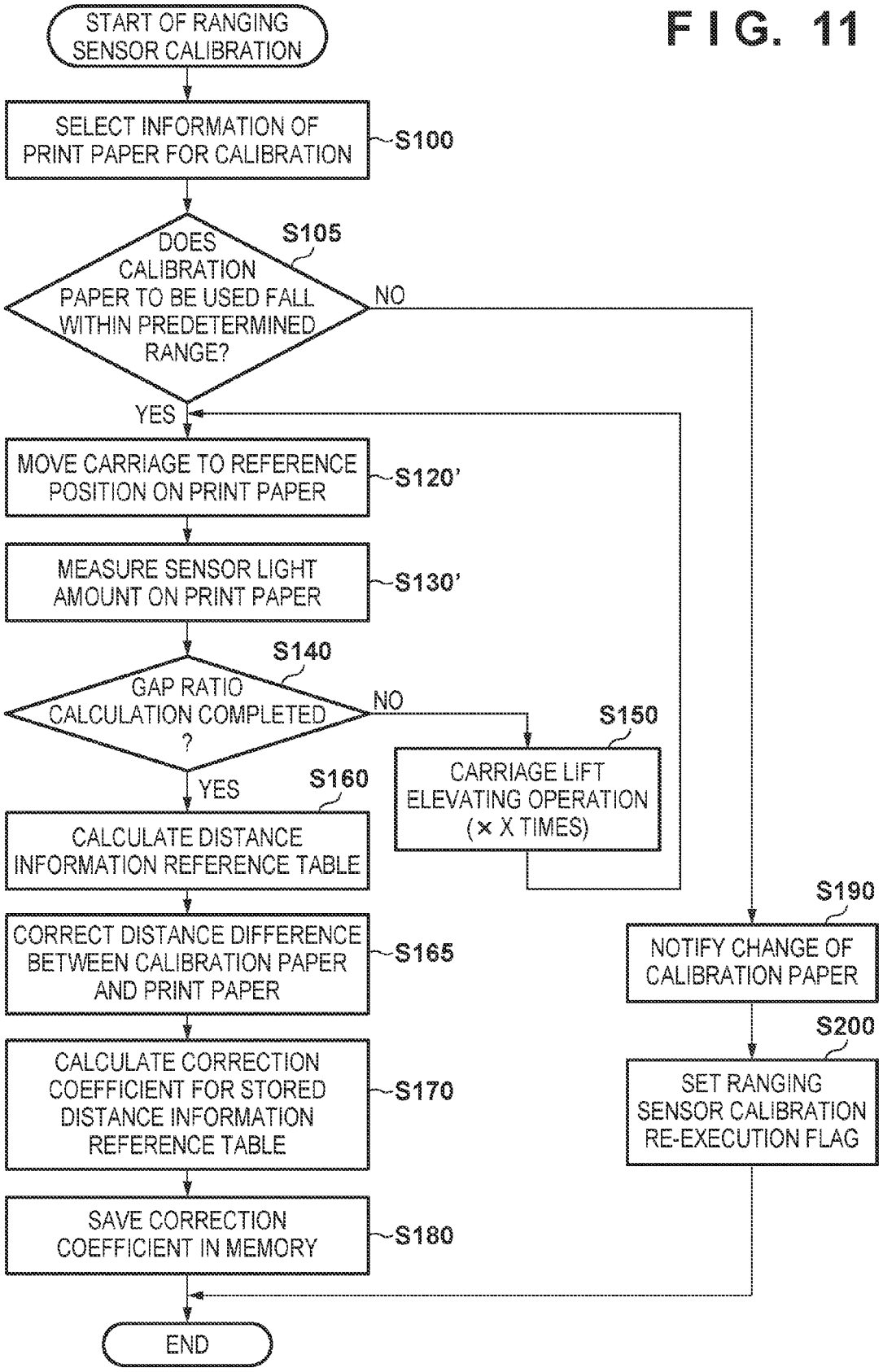
FIG. 11 is a flowchart showing recalibration processing of the ranging sensor using print paper.

FIG. 11 is a flowchart showing recalibration processing of the ranging sensor 207 using the print paper 801. Note that the same processes as already described in the first embodiment are denoted by the same step numbers in FIG. 11, and a description thereof will be omitted.

In this embodiment, pieces of thickness information of various kinds of print paper and the distance from the printhead 201 to the print paper 801 are stored in a storage area 406 of a memory 405 of a printing apparatus 100. Hence, in step S100, the printing apparatus 100 obtains distance information and thickness information of print paper from the storage area 406 in accordance with the information of print paper selected by the user.

Next, in step S105, it is checked whether the obtained thickness or distance falls within a predetermined range of the distance or the thickness of the print paper usable in recalibration. If the obtained thickness or distance falls outside the predetermined range, it is determined that the linearity of the GAP ratio calculated by the ranging sensor 207 cannot be maintained, and calibration is impossible, and the process advances to step S190. In step S190, the user is notified to change the print paper to be used for calibration. This notification is done by a message displayed on a PC 300 or a message display on a display panel 103. In step S200, a re-execution flag for calibration is set in the printing apparatus, and the processing ends.

On the other hand, if the obtained distance or thickness of the print paper falls within the predetermined range, it is determined that recalibration is executable, and the process advances to step S120'. Steps S120' and S130' are the same as steps S120 and S130 except that the print paper to be used is not the print paper for calibration but print paper selected by the user. Hence, as in the first embodiment, the processes of steps S120', S130', S140, and S150 are executed to calculate GAP ratios at three different carriage heights, as suggested in FIGS. 10A to 10C.

In step S160, the relationship between the GAP ratio and the carriage height (Height) is calculated as a distance information reference table, as in the first embodiment. In step S165, the difference between the initial distance information reference table and the newly calculated distance information reference table is obtained. In step S170, the correction coefficient for the initial distance information reference table is calculated from the difference. Finally, in step S180, the correction coefficient is stored in a storage area 407 of the memory 405, as in the first embodiment.

Hence, according to the above-described embodiment, print paper used by the user can be used for recalibration without using print paper for calibration as long as a predetermined condition is met. Note that in this embodiment, recalibration is performed by referring to the information of the distance or thickness of print paper stored in the internal memory of the printing apparatus. However, for example, the user may be caused to directly input the thickness information of print paper to be used from an operation panel 104 of the printing apparatus.

Third Embodiment

An example will be described here with reference to FIGS. 12A to 15, in which according to the use environment of a user, a ranging sensor is calibrated using print paper even if its thickness information is not stored in a storage area 406 of a memory 405 in a printing apparatus.

FIGS. 12A to 14C are views showing the outputs of photoreception units upon recalibrating a ranging sensor 207 using print paper whose thickness information is not stored in the printing apparatus and distance information reference tables newly obtained by recalibrating the ranging sensor. Note that the same reference numerals and symbols as in FIGS. 7A to 7C, 8A to 8C, and 10A to 10C denote the same parts in FIGS. 12A to 14C, and a description thereof will be omitted.

Figure 12A:
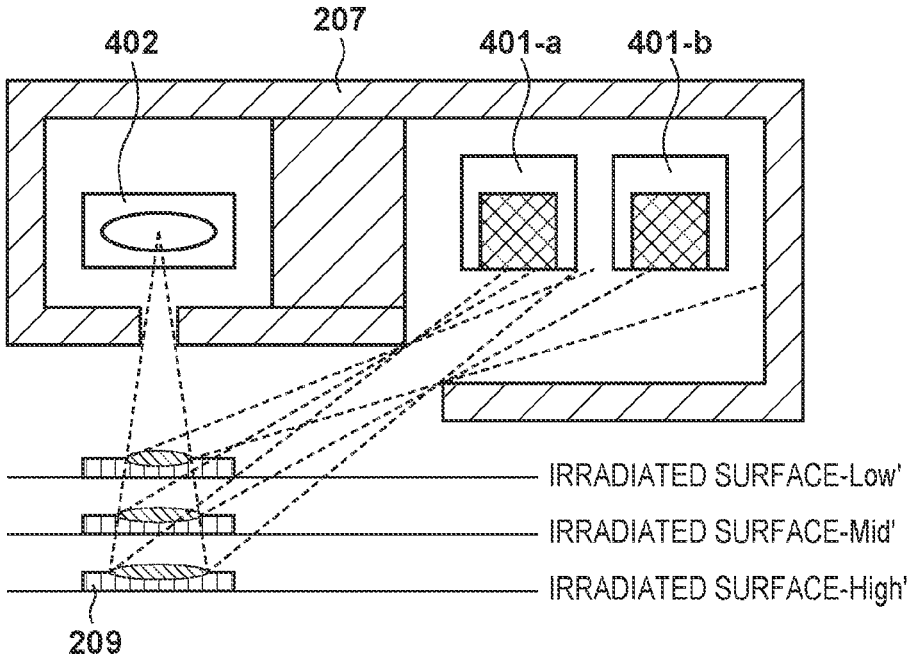
FIGS. 12A, 12B, and 12C are views showing changes in output signals from two photoreception units in a case in which the thickness of print paper used for recalibration is different from the thickness of print paper for calibration and a resultant change in a GAP ratio.
Figure 12B:
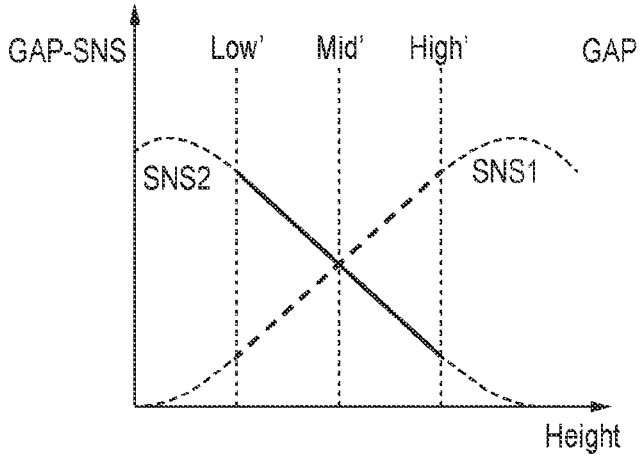
Figure 12C:
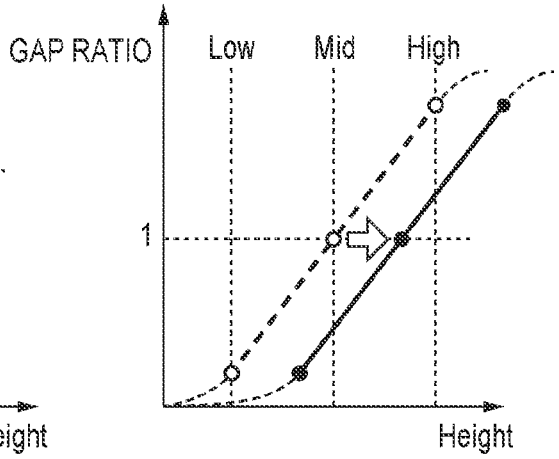
Figure 13A:
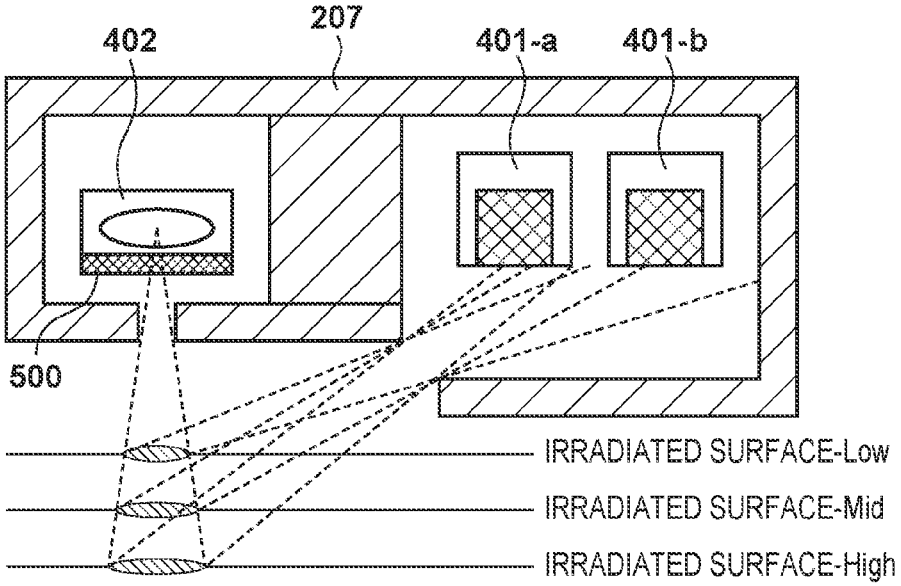
FIGS. 13A, 13B, and 13C are views showing changes in output signals from the two photoreception units in a case in which a decrease in the sensitivity takes place in both of the two photoreception units due to aging deterioration or ink mist adhesion and a resultant change in a GAP ratio.
Figure 13B:
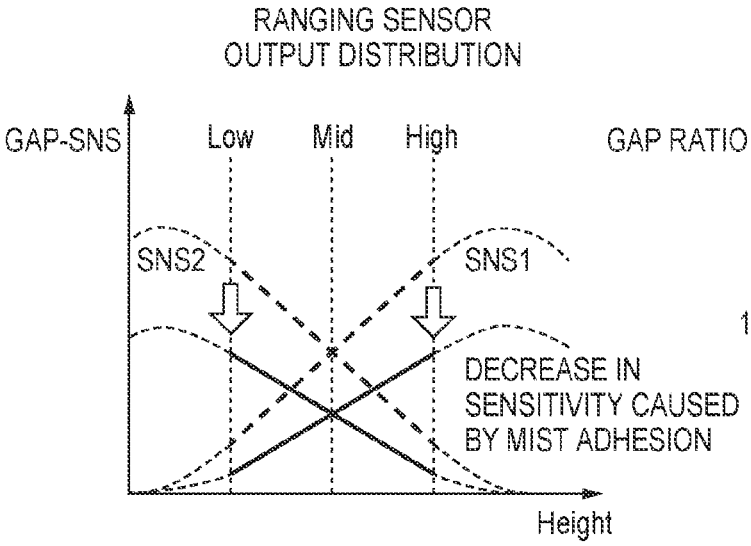
Figure 13C:
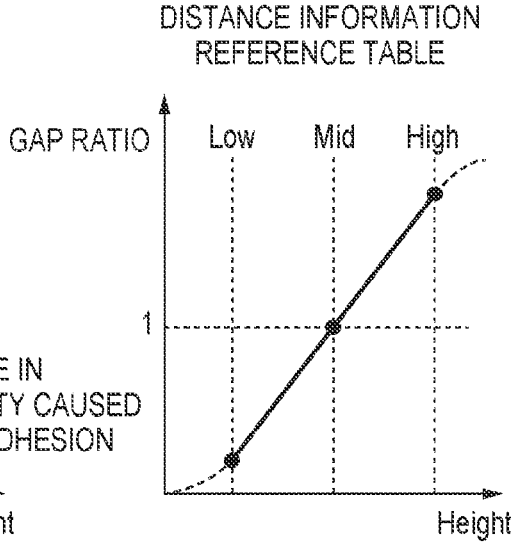
Figure 14A:
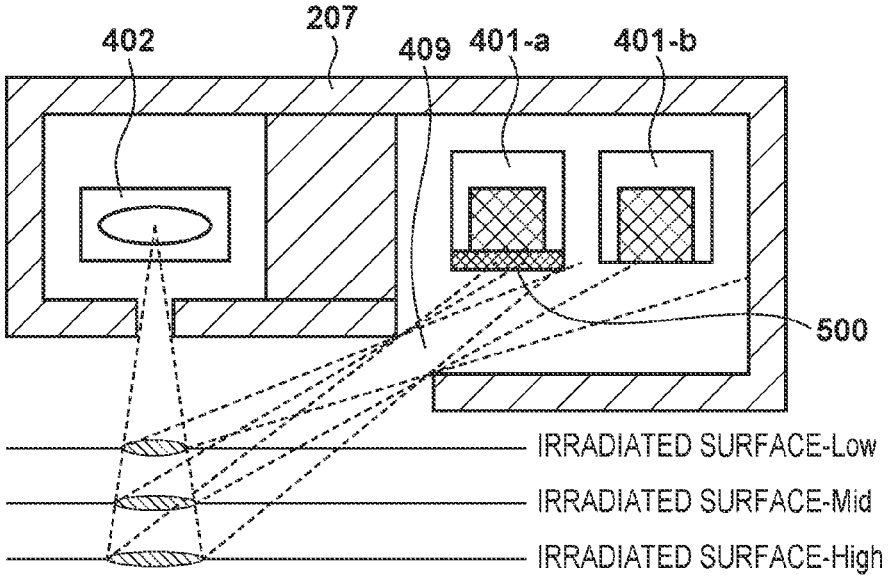
FIGS. 14A, 14B, and 14C are views showing changes in output signals from the two photoreception units in a case in which a decrease in the sensitivity takes place in one of the two photoreception units due to aging deterioration or ink mist adhesion and a resultant change in a GAP ratio.
Figure 14B:
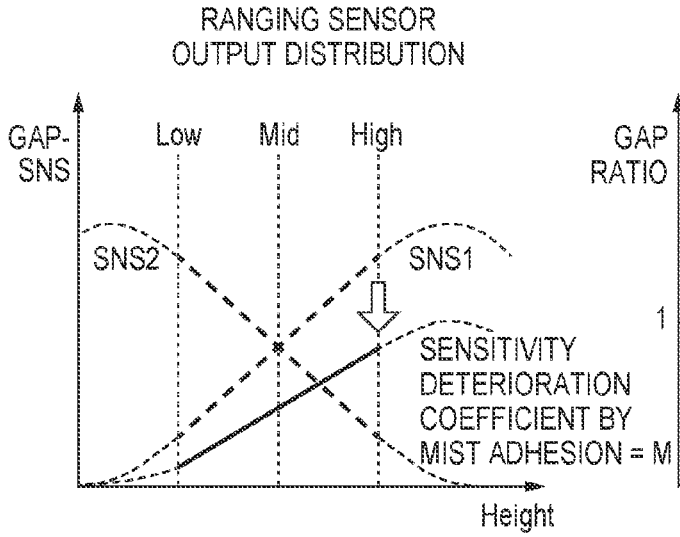
Figure 14C:
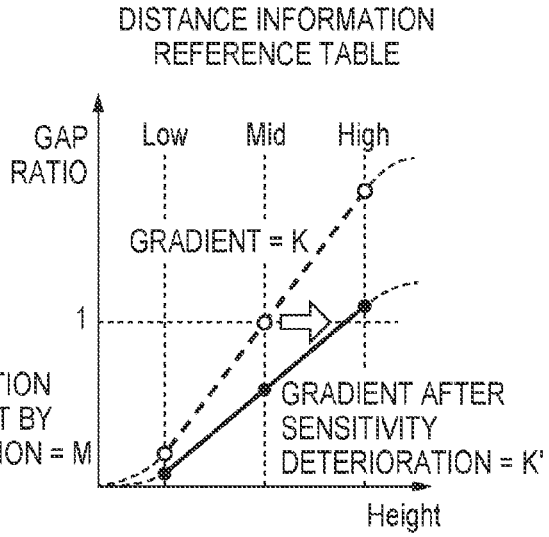

FIGS. 12A to 12C show changes in output signals from two photoreception units in a case in which the thickness of print paper 209 used for recalibration is different from the thickness of print paper 801 for calibration and a resultant change in a GAP ratio. FIGS. 13A to 13C show changes in output signals from the two photoreception units in a case in which a decrease in the sensitivity takes place in both of the two photoreception units due to aging deterioration or ink mist adhesion and a resultant change in a GAP ratio. FIGS. 14A to 14C show changes in output signals from the two photoreception units in a case in which a decrease in the sensitivity takes place in one of the two photoreception units due to aging deterioration or ink mist adhesion and a resultant change in a GAP ratio.

FIG. 12A shows the distances (Low', Mid', and High') of a printhead 201 from the irradiated surface of the print paper 209 at three different carriage heights in a case in which the thickness of the print paper 209 used for recalibration is different from the thickness of the print paper 801 for calibration. Corresponding received light amounts (GAP-SNS) on two photoreception units 401-*a* (SNS1) and 401-*b* (SNS2) are shown in FIG. 12B.

If the thickness of the print paper 209 used for recalibration is different from the thickness of the print paper 801 for calibration, the distance from the irradiated surface of the print paper 209 to the printhead 201 changes from that for the print paper for calibration. For this reason, as shown in FIG. 12C, although the gradient of the GAP ratio (solid line) does not change, the line indicating a change in the GAP ratio is translated in the abscissa (Height) direction.

Hence, calculated distance reference information has a gradient equal to that of distance reference information initially stored in the memory but is translated in the abscissa direction. As described above, even if the thickness of the print paper 209 used for recalibration is different from the thickness of the print paper 801 for calibration, the calculated distance reference information exhibits a characteristic similar to the distance reference information initially stored in the memory. Hence, the calculated distance reference information can be used by correcting the moving amount in the abscissa direction.

FIG. 13A schematically shows a state in which an ink mist 500 adheres to an emitting unit 402, the amount of light emitted by the LED decreases, and the received light amounts on the two photoreception units 401-*a* and 401-*b* decrease. However, since the received light amounts on the photoreception units 401-*a* (SNS1) and 401-*b* (SNS2) decrease by the same amount, as shown in FIG. 13B, the calculated GAP ratio does not change, as shown in FIG. 13C. For this reason, the finally calculated distance information reference table does not change, and the ranging accuracy does not change.

FIG. 14A schematically shows a state in which the received light amount on one photoreception unit 401-*a* decreases due to adhesion of the ink mist 500 to the photoreception surface. As is conventionally known, in a case where two photoreception units are disposed on the ranging sensor 207, the ink mist 500 readily adheres to the photoreception unit 401-*a* close to an opening 409 because of the positional relationship between the opening 409 and the two photoreception units. In this case, the received light amount on the photoreception unit 401-*a* (SNS1) to which the ink mist 500 adheres decreases, as shown in FIG. 14B. For this reason, as shown in FIG. 14C, the GAP ratio changes, and the characteristic of the finally calculated distance information reference table changes. Hence, the ranging accuracy may deteriorate.

The change in the GAP ratio caused by ink mist adhesion to a photoreception unit 401 will be described using equations.

Letting F be the output of the photoreception unit 401-*a*, N be the output of the photoreception unit 401-*b*, and R be the GAP ratio, the relationship between them is given by $$R=F/N \tag{1}$$

The data (distance information reference table) of the initial GAP ratio R with respect to the distance from the printhead 201 to the print paper 209 is stored in a storage area 408 of the memory 405. Letting GAP be the distance from the printhead 201 to the print paper 209, K be the gradient of the function of the distance information reference table shown in FIG. 14C, and C be the reference distance from the printhead of the print paper, GAP is given by $$\mathrm{GAP}=K*R+C \tag{2}$$

When the carriage heights are Low and Mid, distances (GAP1 and GAP2) from the printhead 201 to the print paper 209 obtained by moving a carriage 202 by a lift elevating operation are respectively given by $$GAP1=K*R1+C \quad (3)$$

$$GAP2=K*R2+C \quad (4)$$

where R1 and R2 are GAP ratios obtained in a case where the carriage heights are Low and Mid. The difference between equations (3) and (4) is given by $$(GAP1-GAP2)=K*(R1-R2) \quad (5)$$

If the sensitivity of the photoreception unit 401-*a* is lowered by adhesion of the ink mist 500, as shown in FIG. 14C, the GAP difference between the two carriage heights is given, using a gradient K' of the function of the distance information reference table, by $$(GAP1-GAP2)=K'*(R1-R2) \quad (6)$$

Letting M be the sensitivity deterioration coefficient by the adhesion of the ink mist 500, as shown in FIG. 14B, K' is given by $$K'=K*M(M\leq 1) \quad (7)$$

In the above-described way, the sensitivity deterioration coefficient can be calculated from the change in the gradient of the function representing the distance information reference table and the result of comparison of the GAP ratios at a predetermined distance by the lift elevating operation of the carriage 202.

Figure 15:
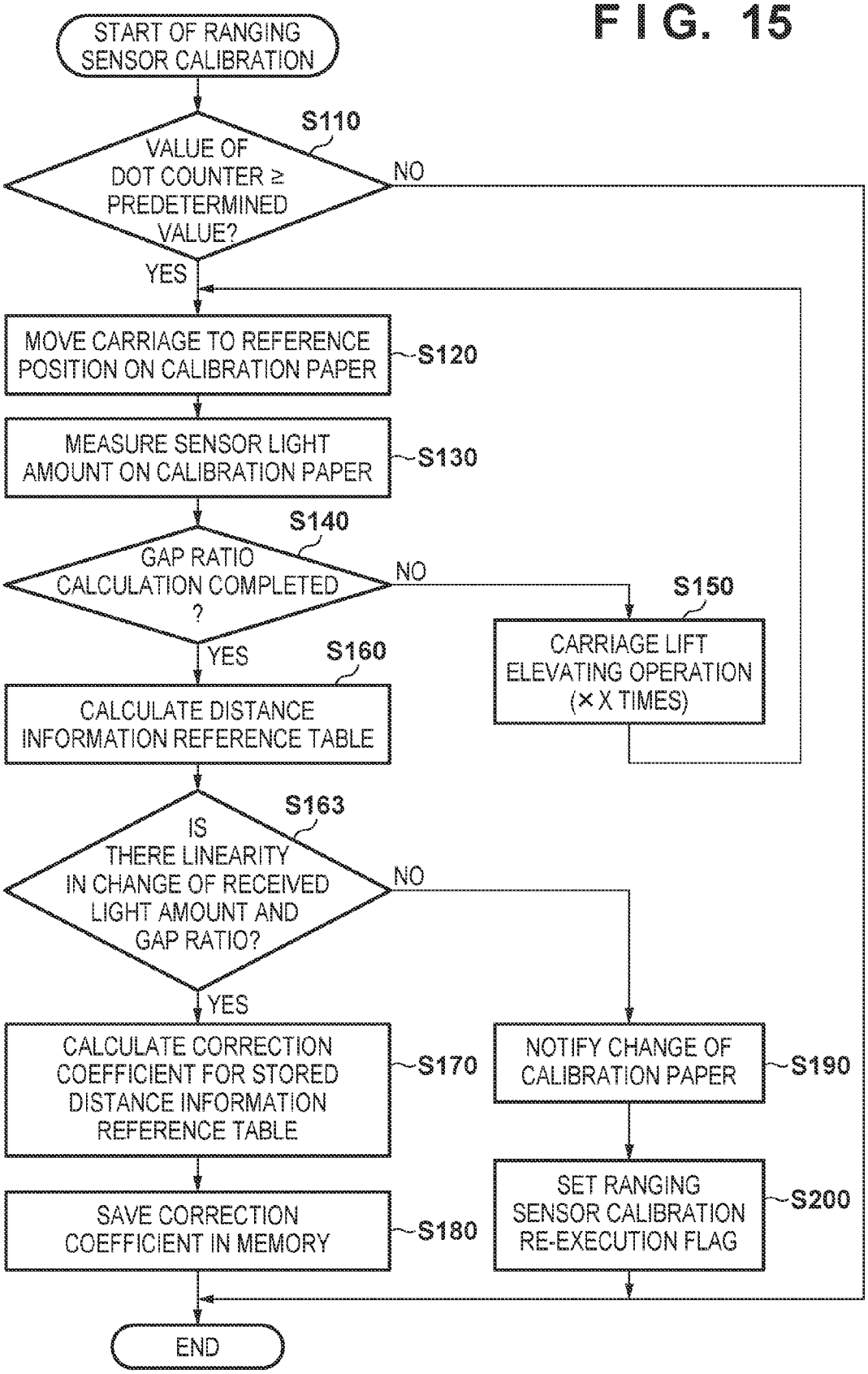
FIG. 15 is a flowchart showing recalibration processing by a user who assumes a decrease in the sensitivity of the ranging sensor caused by ink mist adhesion.

Processing in the above-described case will be described next with reference to the flowchart of FIG. 15. In particular, the flowchart shows recalibration by the user who assumes a decrease in the sensitivity of the ranging sensor 207 caused by ink mist adhesion. Note that the same processes as already described in the first and second embodiments are denoted by the same step numbers in FIG. 15, and a description thereof will be omitted.

According to this embodiment, processing starts from step S110. If the count value of a dot counter is equal to or more than a predetermined amount, the processes of steps S120 to S150 are repeated. After that, in step S160, a distance information reference table as shown in FIG. 12C is created.

Here, assume that a decrease in the sensitivity takes place in the ranging sensor 207 due to adhesion of the ink mist 500, as shown in FIGS. 13A to 14C.

After that, in step S163, to check whether the thickness of the print paper 209 to be used for recalibration falls within a predetermined range, it is checked whether the above-described change in the received light amounts on the two photoreception units or the change in the calculated GAP ratio exhibits linearity. Upon determining that the change does not indicate that the data has linearity, it is determined that the thickness of the print paper 209 to be used by the user exceeds a tolerable thickness, and the process advances to step S190 to prompt to change the print paper to be used for calibration. In step S200, a recalibration flag to execute recalibration is set, and processing is performed. On the other hand, upon determining that the change indicates that the data has linearity, it is determined that the thickness of the print paper used by the user for recalibration falls within the range of the tolerable thickness, and processes of steps S170 and S180 are executed.

Hence, according to the above-described embodiment, the ranging sensor can be calibrated using print paper even if its thickness information is not stored in the storage area of the memory in the printing apparatus.

Fourth Embodiment

An example will be described here with reference to FIGS. 16A to 16C, in which a ranging sensor 207 can be recalibrated using print paper even if its thickness information is not stored in a storage area 406 of a memory 405 in a printing apparatus, as in the third embodiment.

Figure 16A:
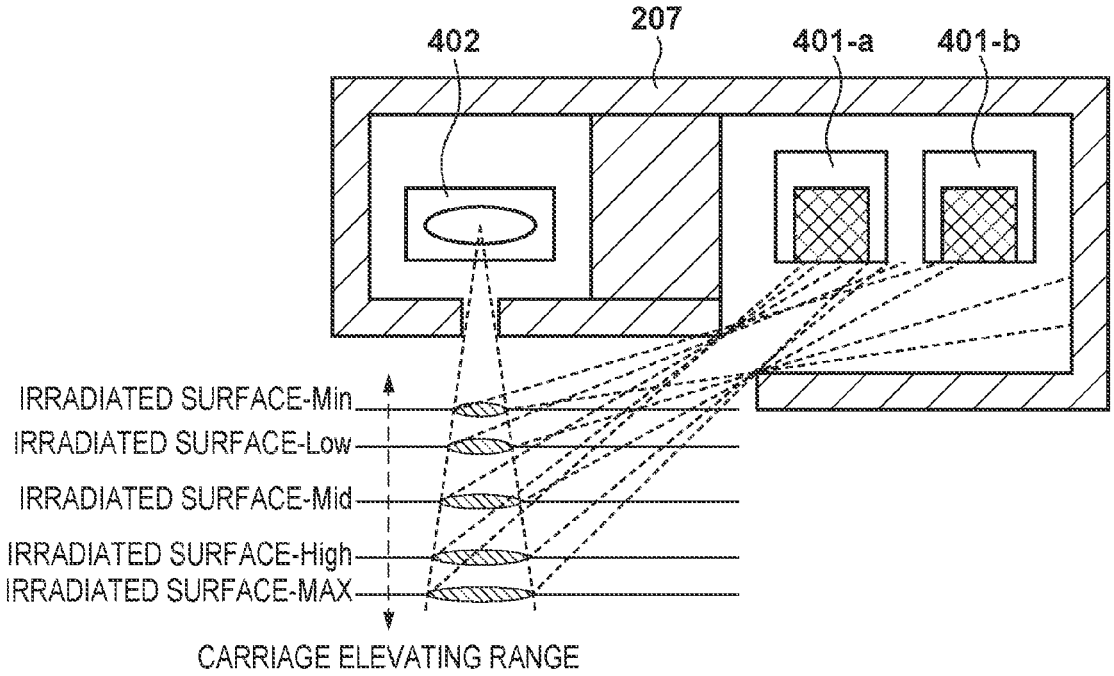
FIGS. 16A, 16B, and 16C are schematic views showing light amount distributions on two photoreception units that receive light emitted by an emitting element and reflected by paper.
Figure 16B:
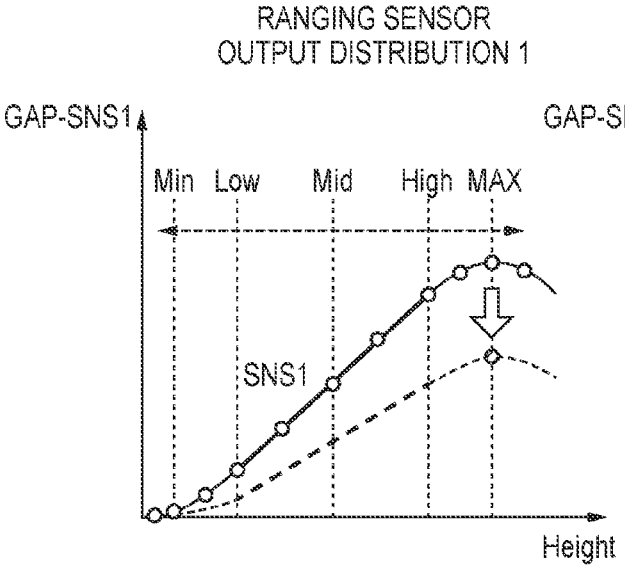
Figure 16C:
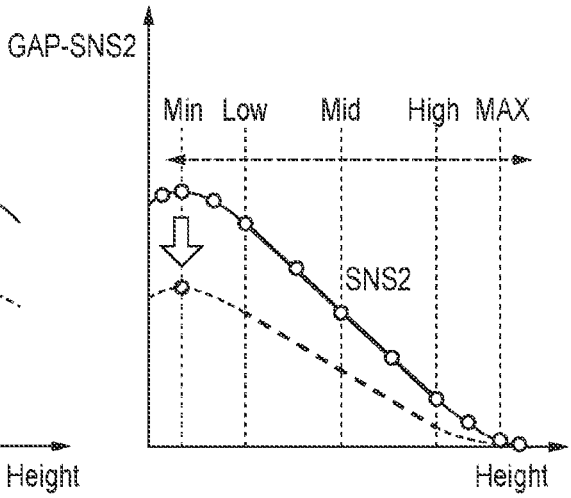

FIGS. 16A to 16C are schematic views showing light amount distributions on two photoreception units that receive light emitted by an emitting element and reflected by paper. Note that the same reference numerals and symbols as in FIGS. 7A to 7C, 8A to 8C, 10A to 10C, 12A to 12C, and 14A to 14C denote the same parts in FIGS. 16A to 16C, and a description thereof will be omitted.

In this embodiment, as shown in FIG. 16A, the lift elevating operation of a carriage 202 is executed a predetermined number of times at the early stage of the operation of the printing apparatus, and received light amounts on photoreception units 401-*a* (SNS1) and 401-*b* (SNS2) of the ranging sensor 207 are measured. At this time, a carriage height (MAX) at which the received light amount on each of the two photoreception units is maximized is measured, and the height and the peak output at the time of maximum output are stored in the memory 405. FIG. 16B shows a change in the received light amount on the photoreception unit 401-*a* (SNS1) with respect to the carriage height, and FIG. 16C shows a change in the received light amount on the photoreception unit 401-*b* (SNS2) with respect to the carriage height.

Assuming that the sensitivity of the ranging sensor 207 is lowered by ink mist adhesion, when the count value (DCNT) of a dot counter is equal to or larger than a predetermined threshold (DCNT≥TH), the distance information reference table of the ranging sensor is corrected by the user.

In this case as well, the lift elevating operation of the carriage 202 is executed using print paper used by the user for recalibration, and a carriage height at which the maximum received light amount is obtained from each of the two photoreception units and a peak output at that time are calculated, as in the early stage of the operation. Then, the carriage heights at which the maximum received light amounts are obtained from the photoreception units and the peak outputs at the above-described early stage of the operation are compared. The ratio of sensitivity decreases caused by ink mist adhesion is obtained for each of the two photoreception units from the comparison result. Based on the ratios of sensitivity decreases, deterioration coefficients by the ink mist are calculated.

Next, a function representing a distance information reference table indicating the relationship between the GAP ratio and the distance from a printhead 201 to print paper 209 at the early stage of the operation is multiplied by the deterioration coefficient of each photoreception unit, thereby newly calculating a function representing a new distance information reference table. Finally, the relationship between the carriage height (Height) in the lift elevating operation of the carriage 202 and the GAP ratio of the two photoreception units is redefined, thus completing correction of the distance information reference table.

Hence, according to the above-described embodiment, it is possible to determine the degree of deterioration of the photoreception units using print paper whose thickness information is not stored in the storage area of the memory in the printing apparatus and recalibrate the ranging sensor based on the determination.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-110798, filed May 29, 2015, which is hereby incorporated by reference herein in its entirety.

What is claimed is:

1. A printing apparatus for, using a printhead mounted on a carriage that reciprocally moves in a predetermined direction, printing on a print medium conveyed in a direction different from the predetermined direction, comprising:

a detection unit provided on the carriage and configured to detect a distance between the printhead and the print medium at a print position by the printhead, a change unit configured to change a height from the print position to the carriage;

a storage unit configured to store first distance information indicating a relationship between the height and a signal representing a result of detection of the distance by the detection unit for each of a plurality of heights while using a print medium for calibration of the detection unit and causing the change unit to change the height;

an obtaining unit configured to obtain second distance information indicating a relationship between the height and the signal representing the result of detection of the distance by the detection unit for each of the plurality of heights while using a predetermined print medium and causing the change unit to change the height; and a correction unit configured to compare the first distance information and the second distance information and correct the first distance information stored in the storage unit, based on a result of the comparison.

2. The apparatus according to claim 1, wherein the detection unit includes:

an emitting unit configured to irradiate the print position with light;

an opening in which reflected light of the light from the emitting unit that has irradiated the print position enters;

a first photoreception unit configured to receive the reflected light that enters via the opening at a first incident angle; and a second photoreception unit configured to receive the reflected light that enters via the opening at a second incident angle different from the first incident angle.

3. The apparatus according to claim 2, wherein a received light amount on the first photoreception unit and a received light amount on the second photoreception unit are different depending on the height.

4. The apparatus according to claim 2, wherein the storage unit stores the height at which the received light amount on one of the first photoreception unit and the second photoreception unit is maximized and the maximum received light amount, the maximum received light amount being obtained by the detection unit while causing the change unit to change the height at an initial stage of an operation of the printing apparatus, and the correction unit corrects the first distance information stored in the storage unit, based on a degree of deterioration of the detection unit obtained by comparing the maximum received light amount stored in the storage unit with the second distance information.

5. The apparatus according to claim 4, wherein the printhead comprises an inkjet printhead configured to print by discharging ink.

6. The apparatus according to claim 5, wherein if an ink mist generated by the ink discharged from the inkjet printhead adheres to the emitting unit, an amount of the light emitted by the emitting unit decreases, and the received light amounts on the first photoreception unit and the second photoreception unit decrease in a similar manner, and if the ink mist generated by the ink discharged from the inkjet printhead adheres to the first photoreception unit, the received light amount on the first photoreception unit decreases more than the received light amount on the second photoreception unit.

7. The apparatus according to claim 5, further comprising:

a first calculation unit configured to calculate a ratio of the received light amount on the first photoreception unit to the received light amount on the second photoreception unit; and a second calculation unit configured to obtain a relationship between the height and the ratio calculated by the first calculation unit as the first distance information and the second distance information, compare the obtained first distance information and the second distance information, and calculate, from the comparison, a correction coefficient for the first distance information.

8. The apparatus according to claim 7, wherein the correction coefficient calculated by the second calculation unit is stored in the storage unit.

9. The apparatus according to claim 5, further comprising:

a count unit configured to count a number of ink droplets discharged from the inkjet printhead;

a comparison unit configured to compare the number counted by the count unit with a predetermined threshold; and a control unit configured to control to operate the obtaining unit and the correction unit in a case where the counted number is not less than the predetermined threshold.

10. The apparatus according to claim 1, wherein the predetermined print medium is one of a print medium for calibration and a print medium used by a user for printing.

11. The apparatus according to claim 10, wherein the storage unit stores information of a thickness of a print medium usable for the calibration and information about the distance from the print position on the print medium to the printhead.

12. The apparatus according to claim 11, further comprising a determination unit configured to, in a case where the print medium used by the user for printing is used for the calibration, determine whether the print medium is usable for the calibration by referring to the information of the thickness of the print medium usable for the calibration and the information about the distance from the print position on the print medium to the printhead, which are stored in the storage unit.

13. The apparatus according to claim 1, further comprising a determination unit configured to determine whether the second distance information has linearity over the plurality of heights, and determine, based on the linearity, whether to correct the first distance information stored in the storage unit by the second distance information.

14. A calibration method in a printing apparatus that, using a printhead mounted on a carriage that reciprocally moves in a predetermined direction, prints on a print medium conveyed in a direction different from the predetermined direction and detects a distance between the printhead and the print medium at a print position by the printhead using a sensor provided on the carriage, the method comprising:

detecting the distance between the printhead and the print medium while using a print medium for calibration of the sensor and changing a height from the print position to the carriage;

storing, in a memory, first distance information indicating a relationship between the height and a signal representing a result of detecting the distance by the sensor for each of a plurality of heights;

obtaining second distance information indicating a relationship between the height and the signal representing the result of detecting the distance by the sensor for each of the plurality of heights while using a predetermined print medium and changing the height; and comparing the first distance information and the second distance information and correcting the first distance information stored in the memory, based on a result of the comparison.

15. The method according to claim 14, wherein the predetermined print medium is one of a print medium for calibration and a print medium used by a user for printing.

16. The method according to claim 15, wherein the memory stores information of a thickness of a print medium usable for the calibration and information about the distance from the print position on the print medium to the printhead.

17. The method according to claim 16, further comprising in a case where the print medium used by the user for printing is used for the calibration, determining whether the print medium is usable for the calibration by referring to the information of the thickness of the print medium usable for the calibration and the information about the distance from the print position on the print medium to the printhead, which are stored in the memory.

18. The method according to claim 14, further comprising:

determining whether the second distance information has linearity over the plurality of heights; and determining, based on the linearity, whether to correct the first distance information stored in the memory by the second distance information.

* * * * *